US009908337B2

(12) United States Patent
Kanaya et al.

(10) Patent No.: US 9,908,337 B2
(45) **Date of Patent: *Mar. 6, 2018**

(54) RECORDING APPARATUS

(71) Applicant: SEIKO EPSON CORPORATION, Tokyo (JP)

(72) Inventors: Munehide Kanaya, Azumino (JP); Shoma Kudo, Shiojiri (JP); Hidenao Suzuki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/451,197

(22) Filed: Mar. 6, 2017

(65) Prior Publication Data

US 2017/0232754 A1 Aug. 17, 2017

Related U.S. Application Data

(63) Continuation of application No. 15/021,811, filed as application No. PCT/JP2014/005593 on Nov. 6, 2014, now Pat. No. 9,643,421.

(30) Foreign Application Priority Data

Nov. 15, 2013 (JP) ..... 2013-236600
Nov. 15, 2013 (JP) ..... 2013-236602

(51) Int. Cl.
*B41J 2/175* (2006.01)
*B41J 2/165* (2006.01)
*B41J 13/10* (2006.01)

(52) U.S. Cl.
CPC ..... *B41J 2/17523* (2013.01); *B41J 2/16523* (2013.01); *B41J 13/106* (2013.01)

(58) Field of Classification Search
CPC ..... B41J 2/1752; B41J 29/02; B41J 2/17513; B41J 29/13; B41J 2/17503; B41J 2/17506;
(Continued)

(56) References Cited

U.S. PATENT DOCUMENTS 6,378,997 B1 4/2002 Nitta
7,425,064 B2 * 9/2008 Koga ..... B41J 2/17509 347/108
(Continued)

FOREIGN PATENT DOCUMENTS

CN 2825289 10/2006
JP 11254700 9/1999
(Continued)

OTHER PUBLICATIONS

Notice of Allowance issued in U.S. Appl. No. 15/021,811 dated Jan. 9, 2017.
(Continued)

*Primary Examiner* — Thinh H Nguyen
(74) *Attorney, Agent, or Firm* — Workman Nydegger

(57) ABSTRACT

There is provided a recording apparatus that can easily set a state in which liquid accommodation units are filled with a liquid for recording while suppressing increases in an installation area. A recording apparatus including a liquid ejecting head that performs recording by ejecting ink onto sheets of paper, a discharge unit in which a discharge opening that includes a discharge region at which the sheets of paper, on which recording was performed by the liquid ejecting head, are discharged, is formed, and liquid accommodation units that are capable of accommodating the liquid that is supplied to the liquid ejecting head, in an apparatus main body, in which the liquid accommodation units are provided with injection openings through which it is possible to inject ink
(Continued)

into the liquid accommodation units, which are provided in a positions that are below the discharge unit in a perpendicular direction (−Z direction) and overlaps with the discharge unit in the perpendicular direction.

10 Claims, 13 Drawing Sheets

(58) Field of Classification Search
CPC .... B41J 2/17509; B41J 2/17523; B41J 2/175; B41J 13/0018
See application file for complete search history.

(56) References Cited

U.S. PATENT DOCUMENTS

| | | | | |
|---|---|---|---|---|
| 7,632,030 | B2 * | 12/2009 | Morikawa | B41J 19/202 400/283 |
| 2003/0184771 | A1 | 10/2003 | Yamamoto et al. | |
| 2005/0088493 | A1 | 4/2005 | Koga | |
| 2005/0212850 | A1 | 9/2005 | Kimura | |
| 2005/0231567 | A1 | 10/2005 | Koga | |
| 2006/0256169 | A1 | 11/2006 | Kobayashi et al. | |
| 2011/0148998 | A1 | 6/2011 | Kobayashi et al. | |
| 2013/0169720 | A1 | 7/2013 | Nakamura et al. | |

FOREIGN PATENT DOCUMENTS

| | | |
|---|---|---|
| JP | 2003200597 | 7/2003 |
| JP | 2003289406 | 10/2003 |
| JP | 2006305941 | 11/2006 |
| JP | 2010155467 | 7/2010 |
| WO | 2013085023 | 6/2013 |

OTHER PUBLICATIONS

International Search Report and Written Opinion issued in PCT Application No. PCT/JP2014/005593, dated Feb. 10, 2015 (10 pages).

* cited by examiner

RECORDING APPARATUS

This application is a Continuation of U.S. application Ser. No. 15/021,811 filed Mar. 14, 2016, which is expressly incorporated herein by reference. The entire disclosures of Japanese Patent Application Nos. 2013-236602, filed Nov. 15, 2013 and 2013-236600, filed Nov. 15, 2013 are expressly incorporated by reference herein.

TECHNICAL FIELD

The present invention relates to a recording apparatus that performs recording by ejecting a liquid onto a target.

BACKGROUND ART

In the related art, as a kind of recording apparatus, an ink jet type printer that performs recording (printing) by ejecting ink, as an example of a liquid, from a liquid ejecting head onto a target such as a sheet of paper, is known. Further, in a case of performing a comparatively large amount of printing in such a printer, there is a demand for stable supply of ink to the liquid ejecting head in a continuous manner. Therefore, a configuration that supplies ink from ink tanks (liquid accommodation units), the ink accommodation capacity of which is relatively large, to the liquid ejecting head through liquid supply tubes, has been suggested (for example, refer to PTL 1). In addition, in this kind of printer, maintenance such as cleaning that discharges ink from a liquid ejecting head using suction, and flushing that discharges ink from the liquid ejecting head using forced ejection are performed in order to eject ink stably from the liquid ejecting head. In addition, during so-called borderless printing that records (prints) on an end unit of a target, ink is also spouted and flung out to a region that juts out from an end unit of a target. Therefore, an ink absorbing material that absorbs the flung out ink is arranged in a recording apparatus (for example, refer to PTL 2).

CITATION LIST

Patent Literature

PTL 1: Chinese Utility Model Registration No. 2,825,289Y

PTL 2: Japanese Unexamined Patent Application Publication No. 2006-305941

SUMMARY OF INVENTION

Technical Problem

In a printer with this kind of configuration, ink tanks are disposed in a manner that does not obstruct operation in the printer. For example, ink tanks are not installed on a front surface side of a printer main body in which a discharge unit, at which sheets of paper are discharged, is positioned, and normally, may be installed on a lateral side of a printer main body that is a horizontal direction side when viewed from the front surface side, or installed on a rear side of a printer main body, which is a side that is in an opposite direction to the front surface side. Therefore, an installation area that is required in order to install the ink tanks in addition to the printer main body, is increased. For example, in a case in which ink tanks are installed on a lateral side of a printer main body, since the installation area is increased in a lateral direction, there is a technical problem in that installation locations are limited.

In addition, the ink tanks may also be positioned in a location that is separated from a front surface side of the printer main body, which serves as a position at which user access such as the recovery of sheets of paper that are discharged from the printer main body, is easy. Therefore, for example, in a case in which an operator sets a state in which such ink tanks are full by injecting ink into the ink tank, it is necessary to make access to the ink tanks easy for the operator by moving the ink tanks from the lateral side of the printer main body to the front surface side. At this time, in a case in which the ink tanks are attached to the printer main body, a troublesome operation of removing the ink tanks from the printer main body is required. In addition, in a case in which the ink tanks are not removed, an operation that involves a load such as moving the printer main body so that the ink tanks moves to the front surface side, is required. In addition, in this kind of printer, maintenance such as cleaning that discharges ink from a liquid ejecting head using suction, and flushing that discharges ink from the liquid ejecting head using forced ejection are performed in order to eject ink stably from the liquid ejecting head. In addition, during so-called borderless printing that records (prints) on an end unit of a target, ink is also spouted and flung out to a region that juts out from an end unit of a target. Therefore, an ink absorbing material that absorbs the flung out ink is arranged in a recording apparatus.

In a printer with this kind of configuration, an ink recovery tank (a separate unit) is installed in a location that does not obstruct operation in the printer. For example, an ink recovery tank is not installed on a front surface side of a printer main body at which recorded targets are discharged, and may be installed on a lateral side of a printer main body that is a horizontal direction side when viewed from the front surface side, or installed on a rear side of a printer main body, which is a side that is in an opposite direction to the front surface side. Therefore, when a user exchanges the ink recovery tank, a troublesome operation that involves a load such as moving the printer main body from an installation location to a location at which an exchange operation of the ink recovery tank is easy, is required.

Additionally, such circumstances are not limited to printers, and are largely common to recording apparatuses that are provided with liquid ejecting heads that perform recording by ejecting a liquid onto a target, discharge units at which targets are discharged, liquid accommodation units that are capable of accommodating a liquid, liquid supply tubes that supply a liquid from liquid accommodation units to a liquid ejecting head, liquid recovery units that are capable of recovering liquid that is discharged from a liquid ejecting head during maintenance of the liquid ejecting head.

The present invention is made by considering the above-described situations, and provides a recording apparatus in which exchange of a liquid recovery unit is easy, and in which it is possible to easily set a state in which liquid accommodation units are filled with a liquid for recording while suppressing an increase in the installation area.

Solution to Problem

Hereinafter, means for solving the abovementioned technical problems and the functional effects thereof will be described.

In order to solve the abovementioned technical problems, there is provided a recording apparatus including a liquid ejecting head that performs recording by ejecting a liquid onto a target, a discharge unit in which a discharge opening that includes a discharge region at which the target, on which recording was performed by the liquid ejecting head, is discharged, is formed, and liquid accommodation units that are capable of accommodating the liquid that is supplied to the liquid ejecting head, in an apparatus main body, the discharge unit is formed on a discharge direction side of the target from discharge means that include a discharge roller that discharges the target, and a driven roller that is disposed facing the discharge roller, and the liquid accommodation units are provided in positions that are below the discharge unit in a perpendicular direction and overlap with the discharge unit in the perpendicular direction when viewed from a direction in which the target is discharged, and are provided with injection openings through which it is possible to refill the liquid accommodation units with the liquid.

According to this configuration, when accessing the liquid accommodation units, an operator can access the liquid accommodation units from a discharge side of the target without moving the recording apparatus. Therefore, by refilling the liquid accommodation units with the liquid from the injection openings, it is possible to easily set a state in which the liquid accommodation units, which are provided in the apparatus main body, are filled with a liquid while suppressing an increase in the installation area of a recording apparatus, by refilling the liquid accommodation units with the liquid from the injection opening.

In order to solve the abovementioned technical problems, there is provided a recording apparatus including a liquid ejecting head that performs recording by ejecting a liquid onto a target, a discharge unit in which a discharge opening that includes a discharge region at which the target, on which recording was performed by the liquid ejecting head, is discharged, is formed, and liquid accommodation units that are capable of accommodating the liquid that is supplied to the liquid ejecting head, in an apparatus main body, the discharge unit is formed on a discharge direction side of the target from discharge means that include a discharge roller that discharges the target, and a driven roller that is disposed facing the discharge roller, and the liquid accommodation units are provided in positions that are below the discharge unit in a perpendicular direction and overlap with the discharge unit in the perpendicular direction when viewed from a direction in which the target is discharged, and are provided with liquid amount visual recognition sections through which it is possible to visually recognize amounts of liquid that are accommodated in the liquid accommodation units.

According to this configuration, since it is possible for an operator to perceive amounts of liquid that are accommodated in the liquid accommodation units by eyesight, for example, it is possible to easily notice a timing at which a state in which the liquid accommodation units are filled with the liquid such as a timing for injecting liquid into the liquid accommodation units should be set. Therefore, it is possible to easily set a state in which the liquid accommodation units are filled with a liquid for recording while suppressing an increase in the installation area of the recording apparatus.

It is preferable that the abovementioned recording apparatus is further provided with a liquid recovery unit that is capable of recovering the liquid that is discharged from the liquid ejecting head during maintenance of the liquid ejecting head, in the apparatus main body, and that the liquid recovery unit is provided below the discharge unit in the perpendicular direction.

According to this configuration, the liquid recovery unit is provided in a position that is in a lower section of the discharge unit of the target and overlaps with the discharge unit. Therefore, in the recording apparatus, it is possible to easily perform an operation that exchanges the liquid recovery unit by accessing the liquid recovery unit from an occupied region of the discharge unit that is provided on the discharge side of a target without obstructing the discharge of the target, and without the user moving the recording apparatus. In addition, since the liquid recovery unit is provided inside the apparatus main body of the recording apparatus, it is possible to suppress an increase in the installation area of the recording apparatus.

In the abovementioned recording apparatus, it is preferable that a supply cassette that is capable of accommodating the target that is supplied to the liquid ejecting head is provided in the apparatus main body in a position that is below the discharge unit in a perpendicular direction and overlaps with the discharge unit in the perpendicular direction when viewed from a direction in which the target is discharged, and that the liquid accommodation units and the liquid recovery unit are provided between the discharge unit and the supply cassette.

According to this configuration, even if the supply cassette is set to be a supply cassette in which the length in the perpendicular direction is large, and which is capable of supplying a relatively large number of sheets of paper P, the recording apparatus can suppress a loss in pressure inside the liquid supply tubes without a distance between the liquid accommodation units and the liquid ejecting head becoming long. The liquid recovery unit suppresses an increase in the installation area of the recording apparatus by overlapping with the discharge unit in a lower section of the discharge unit. In addition, since the liquid recovery unit is not separated from the liquid ejecting head as a result of being positioned in an upper section of the supply cassette, it is possible to easily recover liquid that is discharged from the liquid ejecting head.

In the abovementioned recording apparatus, it is preferable that the supply cassette that is capable of accommodating the target that is supplied to the liquid ejecting head is provided in the apparatus main body in a position that is below the discharge unit in a perpendicular direction and overlaps with the discharge unit in the perpendicular direction when viewed from a direction in which the target is discharged, and that the liquid accommodation units are provided below the supply cassette.

According to this configuration, by changing the size of the liquid accommodation units, it is possible to easily change amounts of liquid that are accommodated in the liquid accommodation units without changing a supply pathway of the target. By changing the size (the thickness) of the liquid recovery unit while suppressing an increase in the installation area as a result of the liquid recovery unit overlapping with the discharge unit, it is possible to easily set an amount of liquid that can be recovered in the liquid recovery unit to be larger without changing a supply pathway of the target from the supply cassette.

In the abovementioned recording apparatus, it is preferable that the liquid accommodation units and the liquid recovery unit are provided inside the apparatus main body on an end unit side of a discharge direction of the target.

According to this configuration, since it is possible for an operator to easily access the liquid accommodation units from the discharge direction of the target, it is possible to easily set a state in which the liquid accommodation units are filled with a liquid. Since it is possible to move the liquid recovery unit from the apparatus main body to a position at which exchange is possible by pulling the liquid recovery unit out, it is possible for an operator to easily perform an exchange operation of the liquid recovery unit.

In the abovementioned recording apparatus, it is preferable that a movement mechanism that is capable of moving the liquid accommodation units is provided in the apparatus main body.

According to this configuration, since it is also possible to move the liquid accommodation units to a position at which an operator can access the liquid accommodation units by moving the liquid accommodation units in the apparatus main body using a movement mechanism, it is possible to easily set a state in which the liquid accommodation units are filled with a liquid.

In the abovementioned recording apparatus, it is preferable that a storage unit that stores the liquid accommodation units and the liquid recovery unit is provided in the apparatus main body, and that the movement mechanism moves the liquid accommodation units and the liquid recovery unit by moving the storage unit.

According to this configuration, by storing the liquid accommodation units and the liquid recovery unit in a freely moveable storage unit, it is possible to make movement of the liquid accommodation units possible in the apparatus main body with a simple configuration.

It is preferable that the abovementioned recording apparatus is further provided with liquid supply tubes that are connected to the liquid accommodation units, and are capable of supplying the liquid to the liquid ejecting head, and that the liquid supply tubes are arranged on an outer side of the discharge unit in a direction that intersects the discharge direction of the target, and supplies the liquid from a lower section side of the discharge unit to an upper section side thereof.

According to this configuration, it is possible to supply the liquid from the liquid accommodation units to the liquid ejecting head without obstructing the discharge of the target to the discharge unit.

In the abovementioned recording apparatus, it is preferable that the liquid supply tubes are connected to the liquid accommodation units at an end unit of a side that in the opposite direction to the discharge direction of the target.

According to this configuration, since it is possible for an operator to access the liquid accommodation units from a discharge direction of the target without the liquid supply tubes becoming an obstruction, it is possible to easily set a state in which the liquid accommodation units are filled with a liquid.

In the abovementioned recording apparatus, it is preferable that the supply cassette that is capable of accommodating the target, and that is capable of supplying an accommodated target to the liquid ejecting head is provided in the apparatus main body in a manner of being removable from below the discharge unit, and that the liquid recovery unit is provided inside the supply cassette.

According to this configuration, since the liquid recovery unit is provided inside the supply cassette in a lower section of the discharge unit, in addition to suppressing an increase in the installation area of the recording apparatus, it is possible to move the liquid recovery unit to the outside of the apparatus main body by pulling out the supply cassette from the apparatus main body.

BRIEF DESCRIPTION OF DRAWINGS

FIG. 2 is a perspective view that shows a configuration of a discharge unit of sheets of paper which the printer is provided with.

FIG. 3 is a perspective view that shows a configuration of a supply cassette of sheets of paper which the printer is provided with.

FIG. 4 is a perspective view that shows a configuration of liquid accommodation units that the printer is provided with.

DESCRIPTION OF EMBODIMENTS

Hereinafter, an ink jet type printer, which is provided with a liquid ejecting head that ejects ink as an example of a liquid for recording, and which prints (records) images that include characters, graphics and the like, by ejecting ink onto sheets of paper as an example of a target, will be described as an example of a recording apparatus with reference to the drawings.

First Embodiment

Figure 1:
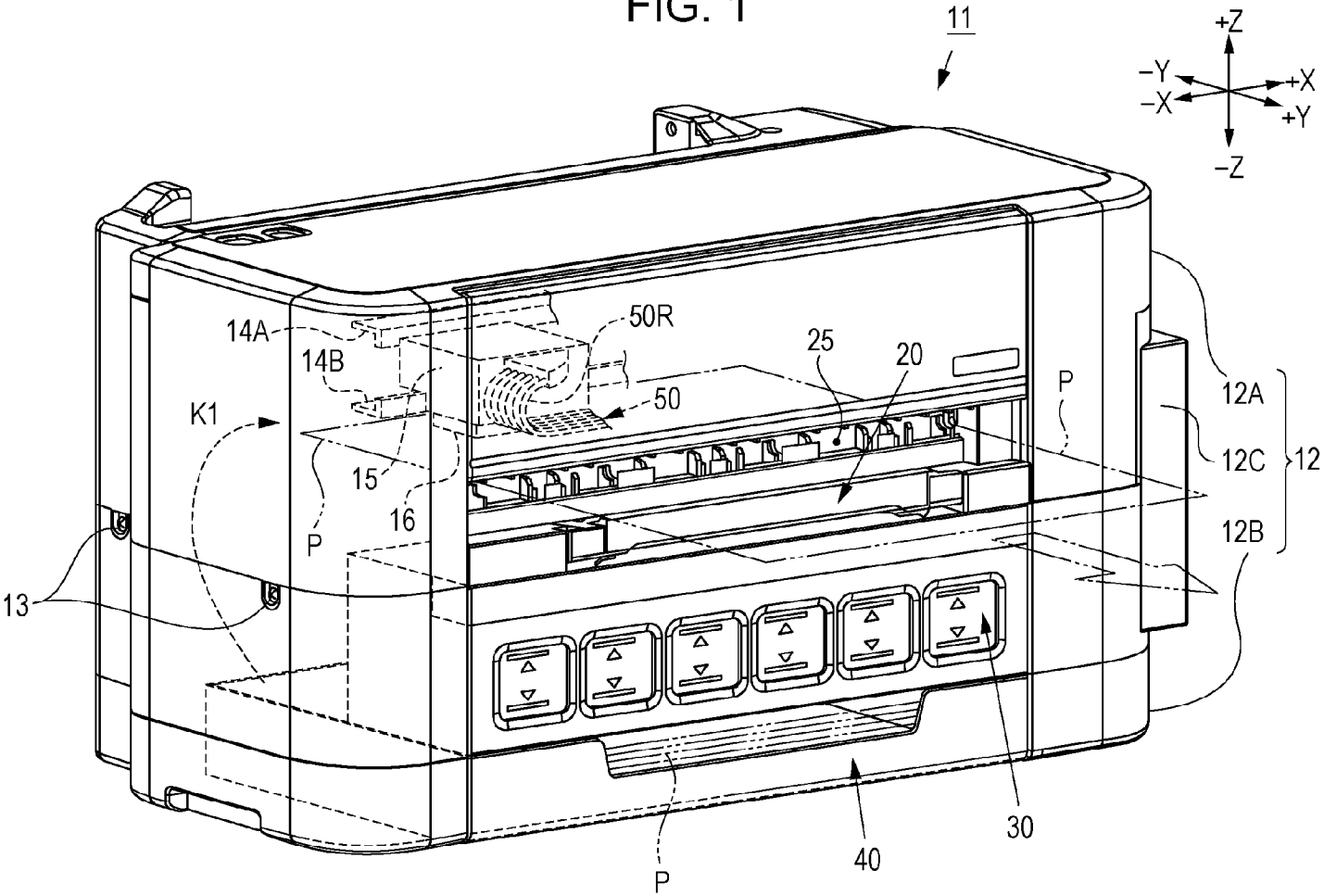
FIG. 1 is a perspective view that shows a printer as an example of an embodiment of a recording apparatus.

As shown in FIG. 1, a printer 11, as an example of a recording apparatus, includes, as an apparatus main body, a printer main body 12, which has a substantially rectangular parallelepiped shape, and which is configured by a plurality of housings of an upper unit side housing 12A that is positioned on an antigravitational (a +Z direction) side in the perpendicular direction, a lower section side 12B that is positioned on a gravitational (a −Z direction) side, and a lid housing 12C that will be described later. Additionally, each of the housings 12A, 12B and 12C are connected and fixed to one another using screws 13 and the like. Further, inside the printer main body 12, the printer 11 is provided with a liquid ejecting head 16, a discharge unit 20 at which sheets of paper P are discharged, liquid accommodation units 30 that are capable of accommodating ink that is supplied to the liquid ejecting head 16, and a supply cassette 40 that is capable of accommodating sheets of paper P that are supplied to the liquid ejecting head 16.

The liquid ejecting head 16 is positioned in an upper section, which serves as an antigravitational (the +Z direction) side, in the perpendicular direction with respect to the discharge unit 20, and ejects ink onto sheets of paper P that are transported through a lower section, which serves as a gravitational (the −Z direction) side, of the liquid ejecting head 16. In addition, the liquid ejecting head 16 is capable of moving in a scanning direction (a ±X direction), which intersects a transport direction (a +Y direction) of sheets of paper P. That is, the liquid ejecting head 16 is attached to a carriage 15 that slides along two guide rails 14A and 14B, which extend in the scanning direction, while being supported by the guide rails 14A and 14B. Therefore, the liquid ejecting head 16 moves in the scanning direction (the ±X direction) according to movement of the carriage 15 in the scanning direction as a result of a driving mechanism, which is not shown in the drawings.

In this manner, printing is performed on sheets of paper P that move in the transport direction by ejecting ink onto the sheets of paper P as appropriate from the liquid ejecting head 16 that moves in the scanning direction. Additionally, in the present embodiment, a discharge direction when printed sheets of paper P are discharged from the printer main body 12 is the same direction as the transport direction (the +Y direction) of the sheets of paper P, and a discharge direction side is set as a front section side of the printer main body 12, that is, a front surface side.

A plurality of liquid supply tubes 50 for supplying ink that is accommodated in the liquid accommodation units 30 are connected to the carriage 15 on a front section (the +Y direction) side that is opposite to a rear section side at which the carriage 15 is supported by the two guide rails 14A and 14B. Each connected liquid supply tube 50 includes a curved section 50R that functions as a deformed moveable section that follows deformation according to movement of the carriage 15, and supplies ink from the liquid accommodation units 30 to the liquid ejecting head 16 via a flow channel, which is not shown in the drawings, and which is provided in the carriage 15 which moves. Additionally, in the present embodiment, six liquid supply tubes 50 are connected to the carriage 15 lined up in a front-rear direction.

The liquid accommodation units 30 are provided in a position that is in a lower section, which serves as a gravitational (the −Z direction) side, in the perpendicular direction with respect to the discharge unit 20, and that overlaps with the discharge unit 20 in the perpendicular direction. The supply cassette 40 is positioned in a position that overlaps with the discharge unit 20 in the perpendicular direction, and is below the liquid accommodation units 30. That is, the liquid accommodation units 30 are provided between the discharge unit 20 and the supply cassette 40. Sheets of paper P that are accommodated in the supply cassette 40 are supplied (fed) from the supply cassette 40 to the liquid ejecting head 16 in the manner that is shown by the dotted line arrow K1 in FIG. 1, using a transport mechanism, which is not shown in the drawings, and which is provided in the printer main body 12, through a supply pathway KK (refer to FIG. 6) that is provided in a rear side of the liquid accommodation units 30.

Next, the discharge unit 20, the supply cassette 40 and the liquid accommodation units 30 will be described.

Figure 2:
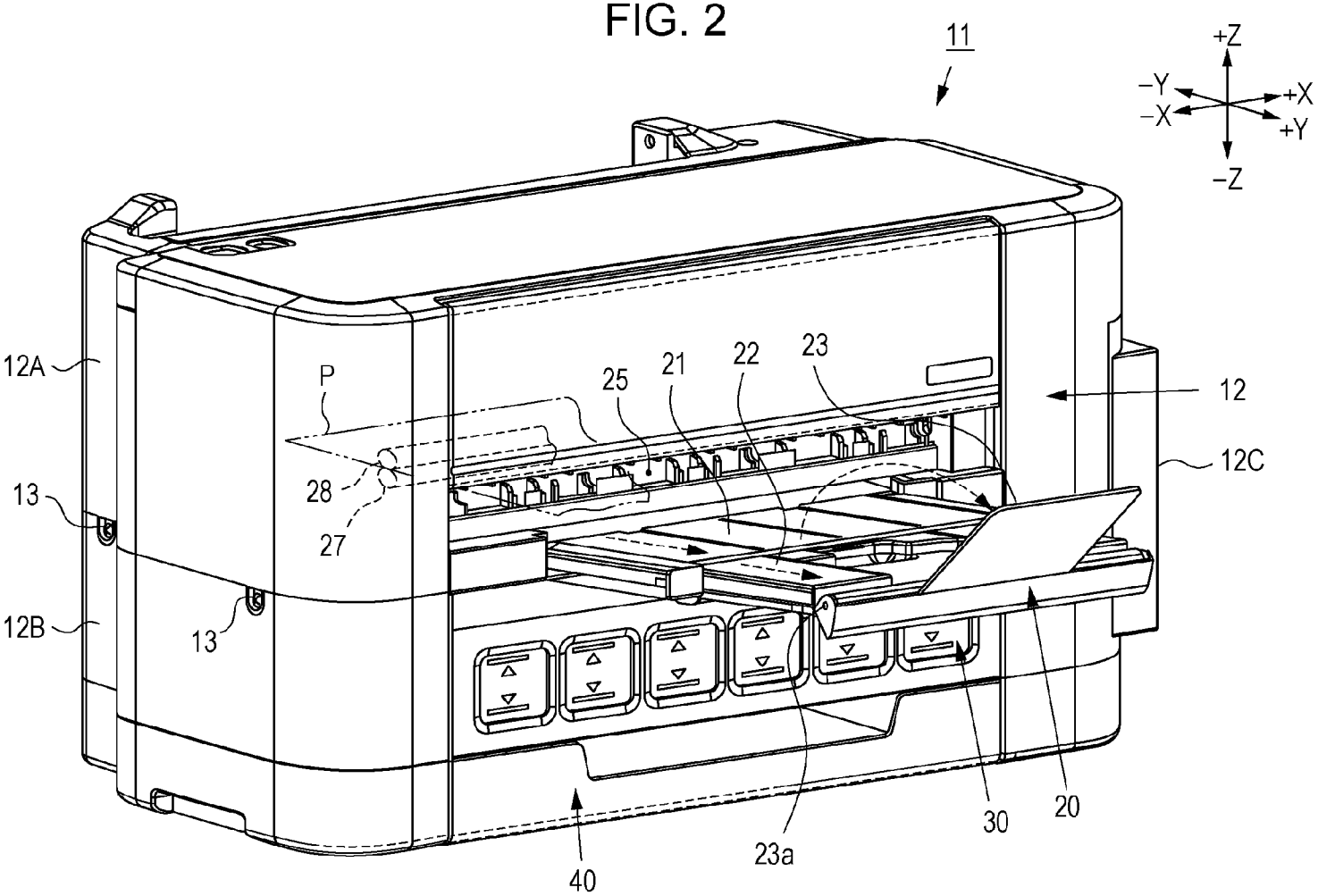

Firstly, as shown in FIG. 2, the discharge unit 20 is provided with a first support platform 21 that is capable of being drawn out from the printer main body 12 to the front section side (the +Y direction side), and a second support platform 22 that is capable of being drawn out from the first support platform 21 to the front section side. Furthermore, a third support platform 23 that is rotatably supported by a rotational shaft 23*a* in which a horizontal direction (the ±X direction) at a front section side end unit of the second support platform 22 is set as an axial line. Further, the discharge unit 20 supports sheets of paper P that are discharged from the printer main body 12 after printing from below.

That is, the discharge unit 20 is drawn out by firstly sliding the second support platform 22 to a front section from the first support platform 21 (the printer main body 12) in the manner that is shown by the dotted line arrow in FIG. 2. Subsequently, the first support platform 21 is drawn out from the printer main body 12 through sliding to the front section with the second support platform 22. Furthermore, the third support platform 23 is drawn out from the second support platform 22 through rotation so that a leading end unit of the third support platform 23 is lifted up from a back side to a near side.

In addition, as shown in FIGS. 1 and 2, in the discharge unit 20, a discharge opening 25 is formed in the front section of the printer main body 12, and the discharge unit 20 discharges from the discharge opening 25 to the front section side of the printer main body 12, which serves as the discharge direction side, using discharge means of sheets of paper P. Therefore, in the present embodiment, upper surfaces of each of the support platforms 21, 22 and 23 which are drawn out on the discharge direction side of sheets of paper P in this manner are set as a discharge region of sheets of paper P, and sheets of paper P are supported from below. Additionally, in the discharge unit 20, in a case of not performing printing on a sheet of paper P, as shown in FIG. 1, the first support platform 21, second support platform 22 and third support platform 23 are set to a state of being stored inside the printer main body 12.

In addition, as shown in FIG. 2, in the present embodiment, discharge means that includes a pair of rollers of a discharge roller 27 that discharges printed sheets of paper P, and a driven roller 28 that is disposed facing the discharge roller 27, is provided inside the printer main body 12. Therefore, the discharge unit 20 is formed from the discharge means to include the discharge region on the discharge direction side of sheets of paper P. Naturally, other than a pair of rollers of the manner mentioned above, the discharge means may also adopt other configurations such as a transport belt.

Figure 3:
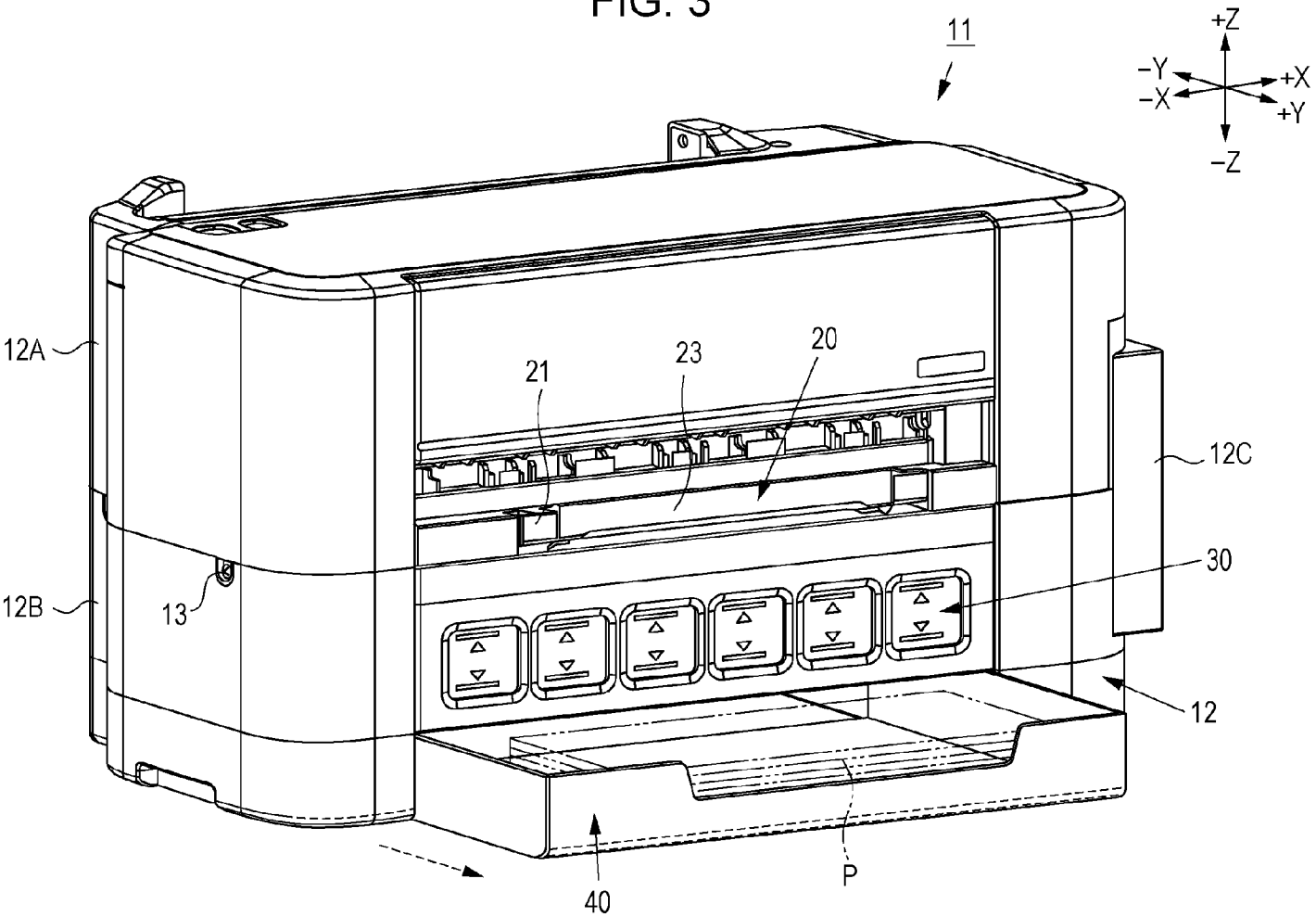

Next, as shown in FIG. 3, the supply cassette 40 that is capable of sliding in a front-rear direction (a ±Y direction) with respect to the printer main body 12 (the lower unit side housing 12B) in a lowermost section of the printer main body 12 as a result of a sliding mechanism that is not shown in the drawings, and is provided in a manner that is removable from the front section side (the front surface side) of the printer main body 12. Further, the supply cassette 40 is drawn out to the front section in a manner that is shown by the dotted line in FIG. 3 when accommodating sheets of paper P inside the supply cassette 40.

Figure 4:
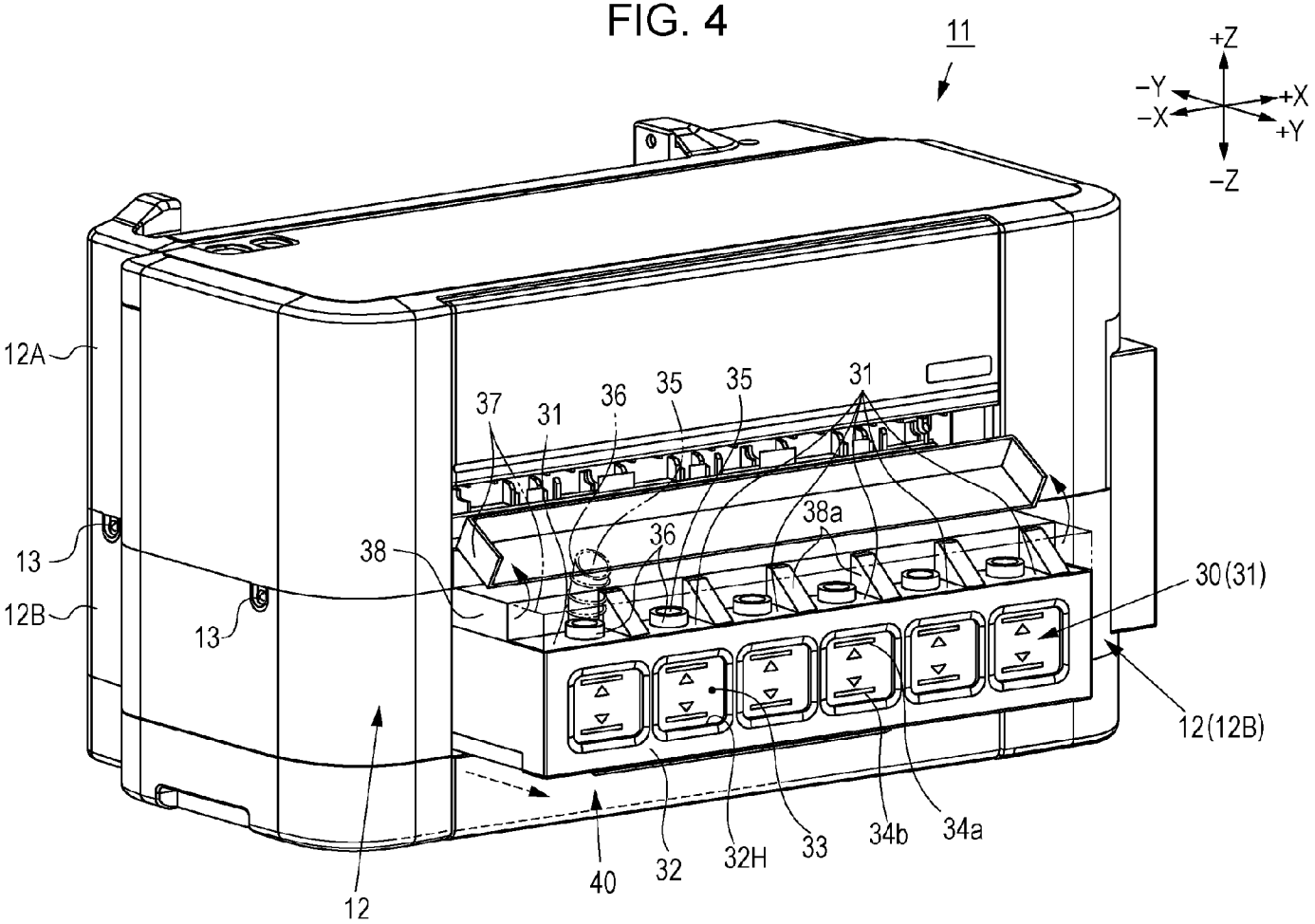
Figure 5A:
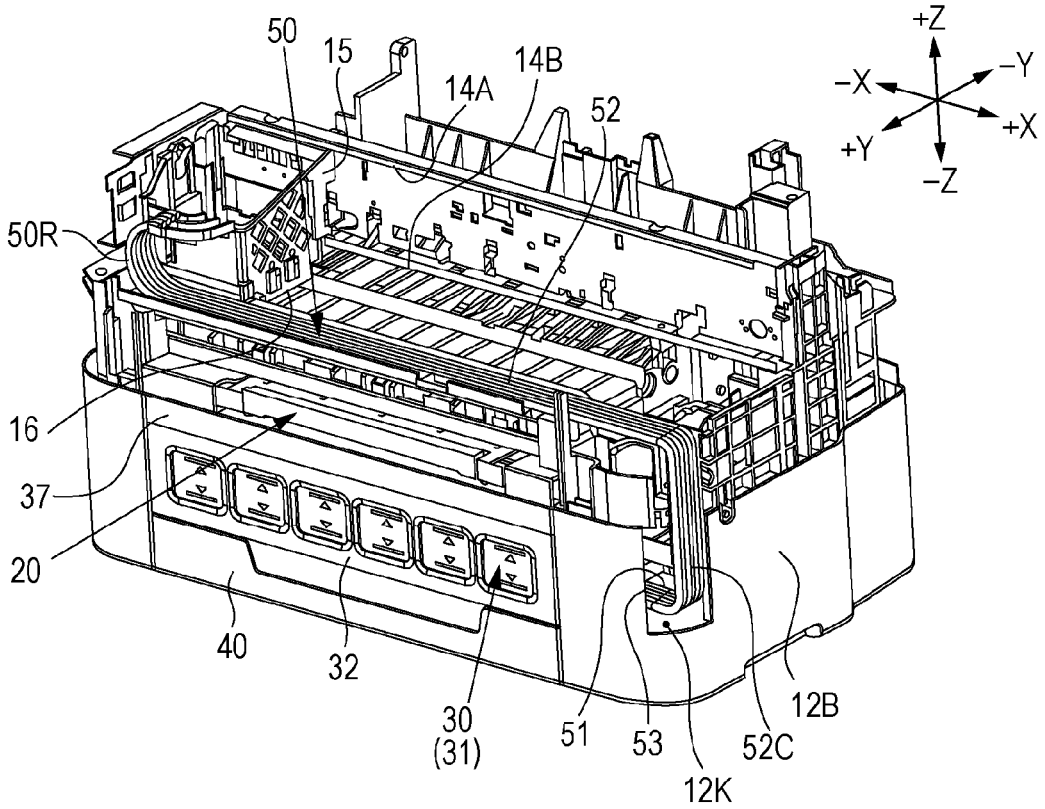
FIGS. 5(*a*) and 5(*b*) are perspective views that show an arrangement state of liquid supply tubes.
Figure 5B:
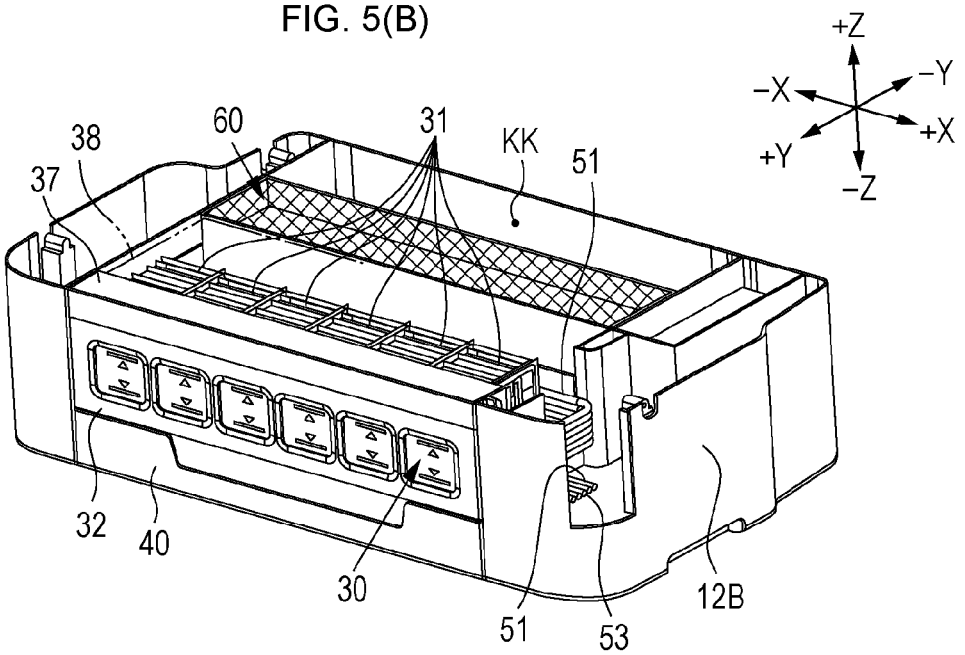

Next, as shown in FIG. 4, in the present embodiment, the liquid accommodation units 30 include six liquid accommodation bodies 31 in which ink of mutually different kinds (for example, colors) is accommodated (refer to FIG. 5(*b*)). Further, the liquid accommodation units 30 are stored in a substantially box-shaped storage unit 32, an upper section of which is open, in a state in which the six liquid accommodation bodies 31 are lined up in a row in the horizontal direction (the ±X direction), which serves as the scanning direction, in a state of being capable of being separated individually, and are provided inside the printer main body 12 at an end unit side in the discharge direction (the +Y direction) of sheets of paper P (refer to FIG. 1).

In the present embodiment, each liquid accommodation body 31 is set as a so-called ink tank, a substantially box type container that is formed by a rigid material (a resin or a metal) that is capable of accommodating ink in an inner section thereof. Additionally, each liquid accommodation body 31 may be stored in the storage unit 32 in a state of being mutually joined to one another. In addition, each liquid accommodation body 31 need not necessarily accommodate six mutually different kinds of ink, and may accommodate two or more or five or less kinds of ink. Furthermore, one kind of ink (for example, black) may be accommodated in a plurality (a maximum of six in this instance) of liquid accommodation bodies 31. Furthermore, in this case, a plurality of liquid accommodation bodies 31 in which the same kind of ink (for example, black) is accommodated may be connected and set as a single liquid accommodation body 31.

A sliding mechanism, which is not shown in the drawings, and which makes movement of the storage unit 32 in the front-rear direction (the ±Y direction) with respect to the printer main body 12 possible, is provided in the storage unit 32, which stores the liquid accommodation units 30, on both side surfaces in the horizontal direction (the ±X direction) as a movement mechanism. Therefore, the liquid accommodation units 30 are set so as to be capable of being drawn out to the outside of the printer main body 12 and capable of being stored inside the printer main body 12 as a result of the storage unit 32 freely sliding in the front-rear direction (the ±Y direction) with respect to the printer main body 12.

In addition, the liquid accommodation units 30 are provided with a liquid amount visual recognition section 33 through which it is possible to visually recognize a liquid amount (a remaining amount) of ink that is accommodated in each liquid accommodation body 31. The liquid amount visual recognition section 33 is a region of the liquid accommodation units 30 (the liquid accommodation body 31) through which visual recognition is possible through a substantially square shaped through hole 32H that is provided on a front side surface of the storage unit 32, and is formed so that it is possible to visually recognize a liquid surface of ink inside the liquid accommodation body 31 at the liquid amount visual recognition section 33. Furthermore, in the liquid accommodation units 30, a lower limit liquid surface line 34*b* that shows that the injection of ink into the liquid accommodation body 31 is required, and an upper limit liquid surface line 34*a* that shows an injection limit of ink inside the liquid accommodation body 31, are formed on the liquid amount visual recognition section 33.

In addition, the liquid accommodation units 30 are provided with six injection openings 35 through which it is possible to respectively inject ink inside each liquid accommodation body 31. Each injection opening 35 is set to be an aperture on an inner side of a cylindrical section 36 that protrudes toward an upper section in an upper surface front end unit of each liquid accommodation body 31. That is, each cylindrical section 36 is set to be a communication hole in which the inside of the cylinder is open between an end side that is in communication with air, and another end side that is inside the liquid accommodation body 31, and it is possible to inject ink inside the liquid accommodation body 31 as a result of the aperture functioning as the injection opening 35 on an inner side of the cylindrical section 36, which is in communication with air of the communication hole.

Furthermore, in the present embodiment, a bellows section that is capable of expanding and contracting is formed inside the cylindrical section 36, and the injection opening 35 is provided so as to be capable of being displaced with respect to the printer main body 12 as a result of the bellows section expanding and contracting. For example, the injection opening 35 is capable of being displaced so as to become separated from the printer main body 12 as a result of the bellows section expanding in the manner that is shown by the dashed-two dotted line in FIG. 4.

Additionally, although illustration has been omitted from FIG. 4, in each liquid accommodation body 31, a cap for preventing ink leakage and the evaporation of ink from the injection opening 35 is attached to the injection opening 35 according to necessity. Naturally, the cap is removed from the injection opening 35 during the injection of ink.

In addition, the liquid accommodation units 30 are provided with a first cover member 37 and a second cover member 38, which cover an upper surface of each liquid accommodation body 31, in order to suppress the adhesion of the foreign matter to the injection openings 35 and the vicinity of the injection openings 35. The first cover member 37 is provided so as to be detachable with respect to an upper surface of each liquid accommodation body 31 while being positioned on a front section side of the second cover member 38 in a manner that covers the injection openings 35. That is, the first cover member 37 is configured so that the injection opening 35 of each liquid accommodation body 31 is exposed by removing the first cover member 37 in the manner that is shown by the solid line arrow in FIG. 4.

In addition, six substantially triangular separation walls 38*a* are formed in the second cover member 38 to correspond to the cylindrical section 36 of each liquid accommodation unit 30. The separation wall 38*a* controls the flow of ink so that spilt ink from the injection openings 35 does not flow into a separate injection opening 35, and so that spilt ink from the injection openings 35 remains in the periphery of the cylindrical section 36 that is provided in the injection openings 35.

Next, an arrangement state of the liquid supply tubes 50 that supply ink from the liquid accommodation units 30 to the liquid ejecting head 16 will be described with reference to FIGS. 5(*a*), 5(*b*) and 6. Additionally, in FIG. 5(*a*), the printer 11 is illustrated in a state in which the upper unit side housing 12A of the printer main body 12 has been removed, and in FIG. 5(*b*), is illustrated in a state in which constituent members that are positioned above the liquid accommodation units 30 in FIG. 5(*a*), and the second cover member 38 have been further removed. In addition, in FIG. 6, a state of in which the state of FIG. 5(*b*) is viewed from a different direction is illustrated.

As shown in FIGS. 5(*a*), 5(*b*) and 6, the printer 11 supplies ink from each liquid accommodation body 31 of the liquid accommodation units 30, which are provided in the lower unit side housing 12B of the printer main body 12 to the carriage 15 (the liquid ejecting head 16) that is positioned above the discharge unit 20, by the liquid supply tubes 50, respectively. That is, each liquid supply tube 50 is flexible, an end 51*a* of each liquid supply tube 50 is connected to a liquid accommodation unit 30 at a side end unit in direction (the −Y direction) that is opposite to the discharge direction (the +Y direction) of sheets of paper P, and thus each liquid supply tube 50 is communicate with each liquid accommodation body 31. Further, a substantially C-shaped bent flow channel unit 52C, which supplies ink from a lower side (the −Z direction side) of the discharge unit 20 to an upper section side (the +Z direction side) thereof on an outer side of the discharge unit 20 in the horizontal direction (the ±X direction), which intersects the discharge direction (the +Y direction) of sheets of paper P, is arranged in the liquid supply tubes 50. That is, the liquid supply tubes 50 are configured by the bent flow channel unit 52C being positioned on the outer side in the right direction (the +X direction) of the discharge unit 20 when viewed from the front surface side of the printer main body 12 in a manner that does not come into contact with sheets of paper P that are discharged from the discharge unit 20.

Furthermore, after being arranged in a manner that extends in an upper section of the discharge unit 20 from the bent flow channel unit 52C toward a left direction (the −X direction), the other end of each the liquid supply tube 50 is connected to the carriage 15 by forming the curved section 50R, which curves in a substantially semi-circular shape. Therefore, after flowing through the bent flow channel unit 52C, which is positioned in an outer side end unit in the right direction (the +X direction) of the discharge unit 20, from a lower section to an upper section, ink that flows out from the liquid accommodation units 30 flows on through the curved section 50R of the liquid supply tube 50, and flows into the carriage 15.

As a result of this, in the liquid supply tubes 50, the curved section 50R functions as a deformed moveable section that follows deformation while changing a formation position thereof according to movement of the carriage 15, and supplies ink from the liquid accommodation units 30 to the carriage 15 which moves. Ink that is supplied to the carriage 15 is supplied to the liquid ejecting head 16 via an ink flow channel, which is not shown in the drawings, and which is provided in the carriage 15. In this manner, in the printer 11, it is possible to supply ink from the liquid accommodation units 30 that are provided in a lower section side of the printer main body 12 to the liquid ejecting head 16 that is provided in an upper section side of the printer main body 12 using the liquid supply tubes 50 which are flexible.

In the present embodiment, the length with which the liquid supply tubes 50, which supply ink from the liquid accommodation units 30 to the liquid ejecting head 16, are arranged is constant regardless of the size of the supply cassette 40. For example, as shown by the dashed-two dotted line in FIG. 6, even if the supply cassette 40 is set to be a deep supply cassette 40, in which a length in the perpendicular direction is large, that is capable of supplying a comparatively large number of sheets of paper P, since the liquid accommodation units 30 are positioned in a lower section of the discharge unit 20, the liquid accommodation units 30 and the liquid ejecting head 16 are not distant from one another.

Additionally, in the present embodiment, each liquid supply tube 50 is connected to at least two tubes in which isolation and connection is possible. That is, as shown in FIGS. 5(*a*) and 5(*b*), each liquid supply tube 50 includes an upstream side tube 51 that is connected to the liquid accommodation unit 30, and a downstream side tube 52 that is connected to the carriage 15, and the upstream side tube 51 can be isolated and connected with the downstream side tube 52 using a connection section 53 that is provided on an upstream side of the bent flow channel unit 52C. Further, an aperture 12K for performing an isolation operation or a connection operation of the upstream side tube 51 and the downstream side tube 52, is respectively provided in the upper unit side housing 12A and the lower unit side housing 12B. Additionally, in the present embodiment, the aperture 12K of the upper unit side housing 12A is not illustrated in the drawings.

Figure 7:
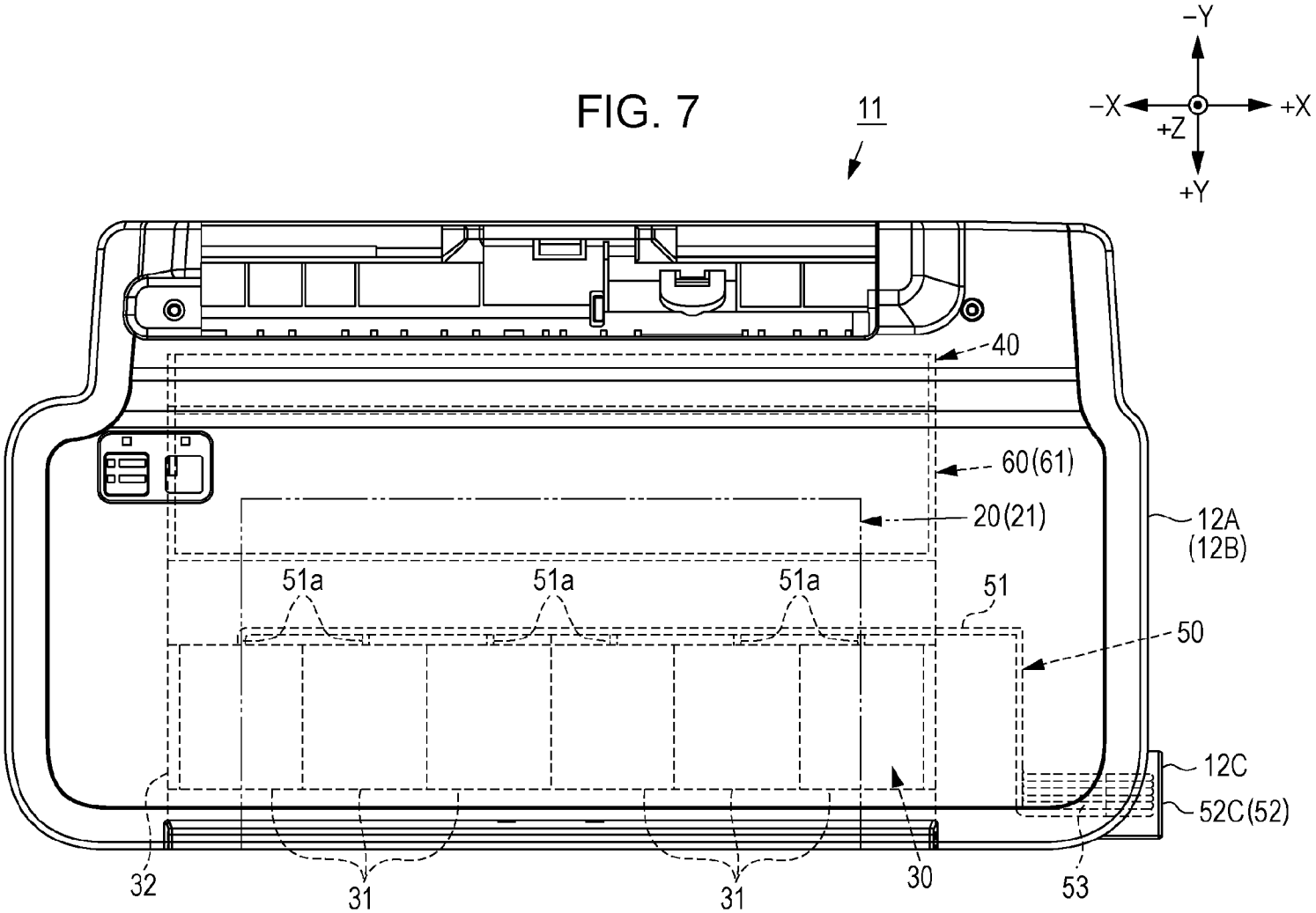
FIG. 7 is a plan view of the printer when viewed from above in a perpendicular direction.

Furthermore, as shown in FIG. 7, a configuration of being covered by the lid housing 12C is set so that the bent flow channel unit 52C of the liquid supply tube 50 is not exposed. That is, the lid housing 12C is attached to the printer main body 12 in a detachable manner so as to close the aperture 12K that is respectively provided in the upper unit side housing 12A and the lower unit side housing 12B. Further, the lid housing 12C is removed from the printer main body 12 when an isolation operation or a connection operation of the upstream side tube 51 and the downstream side tube 52 is performed, and is attached to the printer main body 12 after the isolation operation or the connection operation of the upstream side tube 51 and the downstream side tube 52 has been completed.

Next, a liquid recovery unit 60 will be described.

The liquid recovery unit 60 recovers ink that is discharged from the liquid ejecting head 16 during maintenance of the liquid ejecting head 16 via an ink recovery flow channel that is not shown in the drawings. Alternatively, for example, in borderless printing or the like, among ink that is ejected from the liquid ejecting head 16, the liquid recovery unit 60 may recover ink that is not used in printing through a paper sheet support section that supports sheets of paper P from below during printing.

As shown in FIGS. 5(*b*) and 10, the liquid recovery unit 60 is provided with a bottomed box type case body 61 that includes a substantially rectangular aperture when viewed from above (the +Z direction), and an ink absorbing material 62 that is capable of absorbing ink that is inserted into the case body 61 (a portion that is shown by cross-hatching in the drawings). As the ink absorbing material 62, for example, it is possible to use a foam material that is made from a resin such as sponge. Additionally, the liquid recovery unit 60 is provided with a cover member that controls the evaporation of ink from the ink absorbing material 62.

In the present embodiment, the liquid recovery unit 60 is stored in a position that is close to the liquid ejecting head 16, or a position that is close to the paper sheet support section, that is, the case body 61 is stored in the storage unit 32 in a position that is on a rear section side of the liquid accommodation units 30, in order to efficiently recover ink without the ink recovery flow channel becoming long. Therefore, a supply pathway KK through which sheets of paper P, which are accommodated in the supply cassette 40 that is positioned on a lower (the −Z direction) side of the liquid recovery unit 60, are supplied to the liquid ejecting head 16, is formed between the liquid recovery unit 60 and the lower unit side housing 12B that is positioned in a rear section of the liquid recovery unit 60.

In addition, in the present embodiment, the printer 11 has a configuration in which it is possible to exchange the ink absorbing material 62 in the liquid recovery unit 60. That is, the liquid recovery unit 60 is provided on a lower side of the discharge unit 20 in the same manner as the liquid accommodation units 30, and is set so that it is possible to draw the liquid recovery unit 60 out to a drawing-out direction side of the discharge unit 20, that is, a front section (the +Y direction) side of the printer main body 12, as a result of sliding the storage unit 32. Further, the liquid recovery unit 60 is set so that it is possible to position the liquid recovery unit 60 to the outside of the printer main body 12 (the lower unit side housing 12B) in the manner that is shown by the dashed-two dotted line in FIG. 10, as a result of drawing the liquid recovery unit 60 out.

Therefore, the liquid recovery unit 60, which can be drawn out to the outside of the printer main body 12 in this manner, is formed so that a length thereof in the horizontal direction of the case body 61 (the ±X direction) is less than or equal to the length of the liquid accommodation units 30. In other words, it is possible to increase the length of the case body 61 in the horizontal direction up to the same length as the length of the liquid accommodation units 30. Incidentally, in the present embodiment, the length of the case body 61 in the horizontal direction is set to be substantially the same length as the length of the liquid accommodation units 30.

Figure 10:
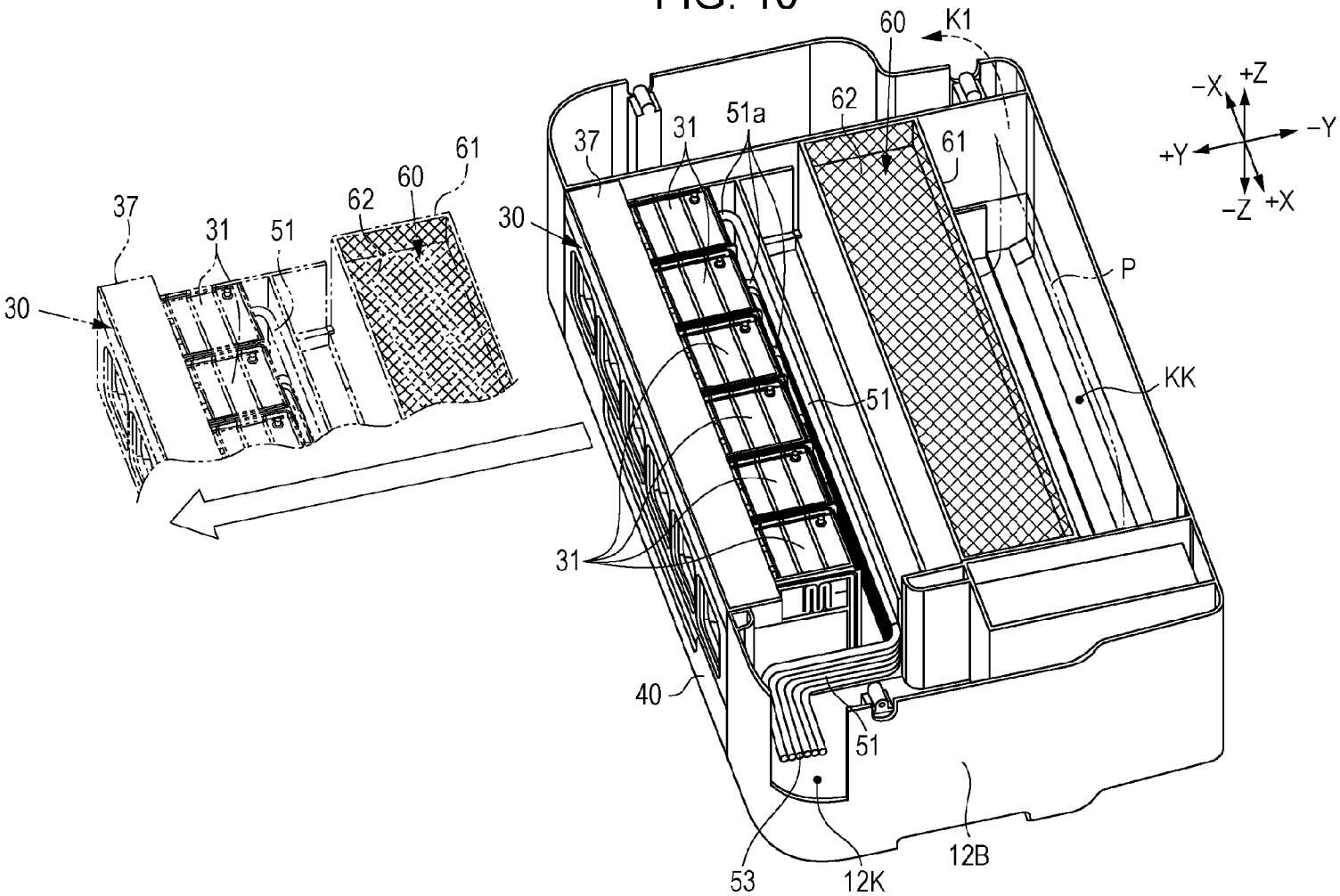
FIG. 10 is a perspective view that shows a connection state of the liquid supply tubes to the liquid accommodation units, and the liquid recovery unit.

In addition, as shown in FIGS. 10 and 7, it is possible to increase the length of the case body 61 of the liquid recovery unit 60 in the front-rear direction up to a position at which a rear section side of the case body 61 can form the supply pathway KK of the sheets of paper P, or up to a position that is adjacent to the liquid accommodation units 30, which is a position in which a front section side of the case body 61 overlaps with the discharge unit 20 in the perpendicular direction. In addition, since the discharge unit 20 has a length in the front-rear direction that corresponds to discharged sheets of paper P, even if a liquid recovery unit 60 that is provided in a position that overlaps with the discharge unit 20, it is possible to increase the length of the liquid recovery unit 60 in the front-rear direction to correspond to the discharge unit 20. As a result of this, it is possible to provide the printer 11 with a liquid recovery unit 60 in which the capacity of the ink absorbing material 62 is large in the printer main body 12.

Next, a function of the present embodiment, that is, an exchange action (a function) that exchanges the ink absorbing material 62 in the liquid recovery unit 60 with a new ink absorbing material 62, will be described with reference to FIGS. 1, 4, 10 and 7. The exchange action is performed by a user of the printer 11, or an exchange operator (simply referred to as an "operator") of the ink absorbing material 62 such as a consignee to whom the exchange of the ink absorbing material 62 has been consigned by the user.

Meanwhile, as shown in FIG. 4, in a case in which an operator exchanges the ink absorbing material 62 of the liquid recovery unit 60, firstly, the operator slides the storage unit 32 in a manner that draws the liquid accommodation units 30 out from inside the printer main body 12 to a front section side (the front surface side). As a result of the sliding of the storage unit 32, the liquid recovery unit 60 that is stored in the storage unit 32 and the liquid accommodation units 30 are drawn out in the discharge direction (the +Y direction) from the printer main body 12 in the manner that is shown by the dashed-two dotted line in FIG. 10, and the liquid recovery unit 60 pulled out to the outside of the printer main body 12.

At this time, in the front surface side of the printer main body 12, normally, a discharge space that the discharge unit 20, which is drawn out in order to receive discharged sheets of paper P, occupies, is secured as an occupied region. Therefore, the operator can pull the liquid recovery unit 60 out to the outside of the printer main body 12 from the front surface side (the front section side) of the printer main body 12, which includes the discharge space (the occupied region) in a manner in which it is possible to access the liquid recovery unit 60 without moving the printer 11.

Next, the operator accesses the pulled out liquid recovery unit 60, takes the ink absorbing material 62 out from the case body 61, and exchanges the ink absorbing material 62 with a new ink absorbing material 62. Further, as shown in FIGS. 1 and 7, the liquid recovery unit 60, in which the ink absorbing material 62 has been exchanged in this manner, is pushed into the printer main body 12 again by sliding the storage unit 32 and the liquid accommodation units 30. As a result of this pushing-in, the printer 11 attains a printable state in which the printer 11 is provided with the liquid recovery unit 60 and the liquid accommodation units 30.

In the printer 11 that is in the printable state, the liquid recovery unit 60 is provided inside the printer main body 12 in a position that is below (in the −Z direction) the discharge unit 20 in the perpendicular direction and overlaps with the discharge unit 20 in the perpendicular direction. Therefore, the printer 11 of the present embodiment is provided with a liquid recovery unit 60 in which the area that is occupied in order to install the printer 11, that is, the area of the printer main body 12 when viewed from the perpendicular direction, is not increased.

Next, a function of the present embodiment, that is, an injection action (a function) that injects ink into the liquid accommodation units 30 (the liquid accommodation bodies 31) from the injection openings 35 in a case in which there is no ink to supply from the liquid accommodation units 30 to the liquid ejecting head 16, or the like, will be described with reference to FIGS. 1, 4, 6 and 7. The injection action performed by an injection operator (simply referred to as an "operator") such as a consignee to whom the injection of ink has been consigned or a user of the printer 11.

Figure 6:
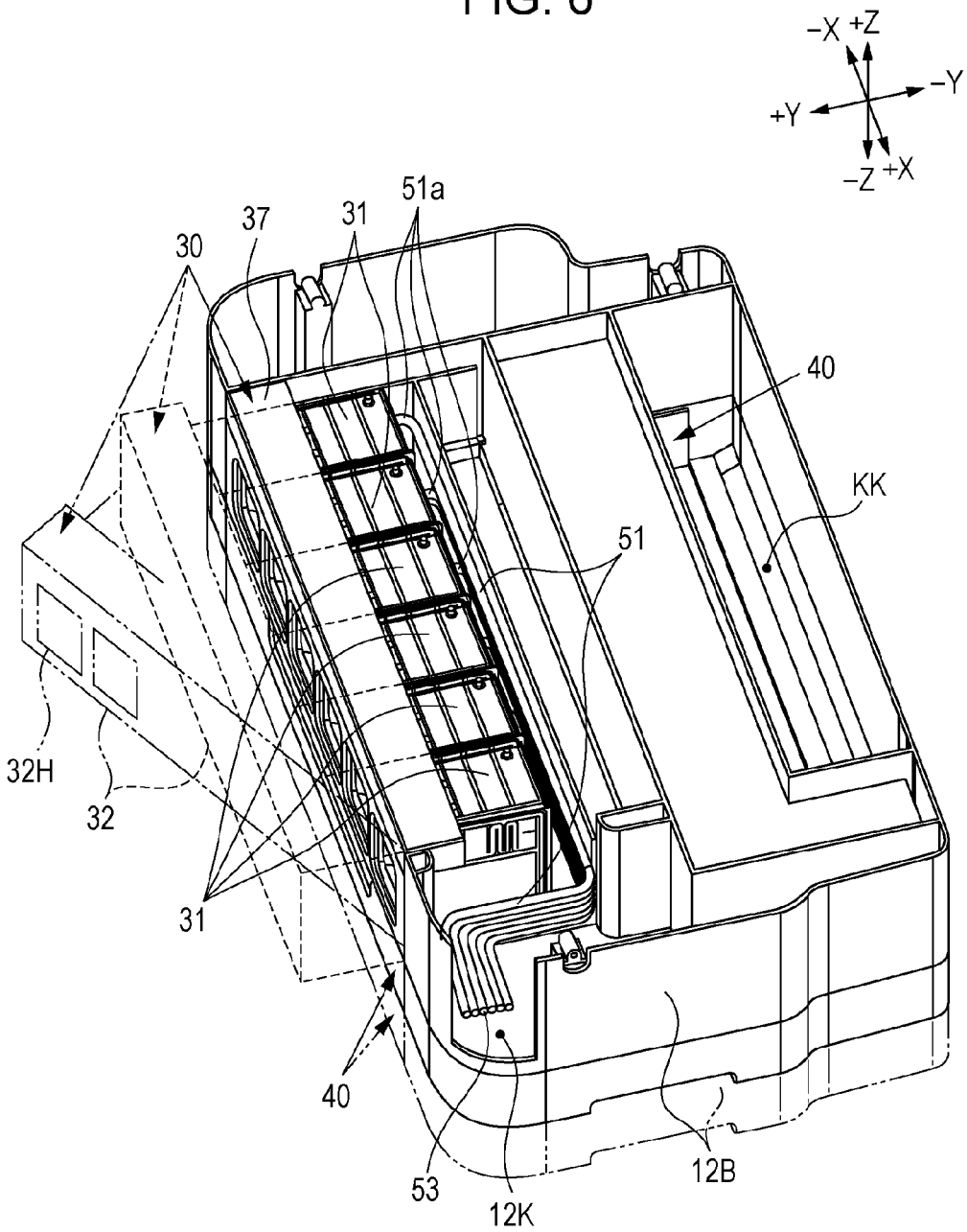
FIG. 6 is a perspective view that shows a connection state of the liquid supply tubes to the liquid accommodation units.

Meanwhile, as shown in FIGS. 4 and 6, when the liquid accommodation units 30 (the liquid accommodation body 31) are filled with ink, the operator draws the liquid accommodation units 30 out from inside the printer main body 12 to the front section side (the front surface side). In the present embodiment, by the sliding mechanism provided in the storage unit 32, the liquid accommodation units 30 and the storage unit 32 are drawn out in the discharge direction (the +Y direction) from the printer main body 12 in the manner that is shown by the broken line in FIG. 6. Additionally, a rotational mechanism in which the storage unit 32 is drawn out to the front from an end unit side in the left direction (the −X direction) when viewed from the front surface side by rotation (swinging) with the perpendicular direction set as an axial direction in the manner that is shown by the dashed-two dotted line in FIG. 6, may be provided as a movement mechanism using a hinge, which is not shown in the drawing, and which is provided in an end unit in the right direction (the +X direction) when viewed from the front surface side.

At this time, in the front surface side of the printer main body 12, normally, a discharge space that the discharge unit 20, which is drawn out in order to receive discharged sheets of paper P, occupies, is secured. Therefore, the operator can perform a drawing-out operation of the liquid accommodation units 30 from the front surface side (the front section side) of the printer main body 12, which includes the discharge space without moving the printer 11. As a result of the drawing-out operation, it is possible for the operator to pull the liquid accommodation units 30 out to the front section side (the front surface side) of the printer main body 12 by a predetermined amount.

Next, the operator exposes the injection openings 35 by opening the first cover member 37 of the liquid accommodation units 30, which has been pulled out by a predetermined amount, and displaces the injection openings 35 toward an upper section by stretching the bellows section of the cylindrical section 36 according to necessity. Further, the operator sets a state in which the liquid accommodation units 30 are filled with ink by injecting ink into the liquid accommodation bodies 31 from the injection openings 35, which are exposed or displaced in the abovementioned manner.

At this time, it is possible for the operator to confirm liquid amounts of ink that are injected into the liquid accommodation units 30 (the liquid accommodation bodies 31) using the liquid amount visual recognition section 33 that is provided on the front surface side of the printer main body 12. Therefore, it is possible for the operator to easily inject ink up to the upper limit liquid surface line 34*a* that shows an injection limit of ink inside each liquid accommodation body 31 of the liquid accommodation units 30.

As shown in FIGS. 1 and 7, the printer 11 is set to a printable state by pushing the liquid accommodation units 30 that are set to a state of being filled with ink in this manner and the storage unit 32 inside the printer main body 12. Further, in the printer 11 that is in the printable state, the liquid accommodation units 30 that have been pushed into the printer main body 12 are provided in a position that is below (in the −Z direction) the discharge unit 20 in the perpendicular direction and overlaps with the discharge unit 20 in the perpendicular direction. Therefore, the liquid accommodation units 30 suppress increases in an area of the printer main body 12 when viewed from the perpendicular direction, that is, an area of the printer main body 12 that is during installation of the printer 11.

According to the first embodiment, it is possible to obtain the following effects.

(1) When accessing the liquid accommodation units 30 (the liquid accommodation bodies 31), the operator can access the liquid accommodation units 30 from the discharge side of sheets of paper P without moving the printer 11. Therefore, by injecting ink from the injection openings 35, it is possible to easily set a state in which the liquid accommodation units 30, which are provided in the printer main body 12, are filled with an ink for printing (recording). In addition, since the liquid accommodation units 30 are provided in a manner that overlaps with the discharge unit 20 inside the printer main body 12 when viewed from the perpendicular direction, an increase in the installation area of the printer 11 are even suppressed if a liquid accommodation units 30 in which the ink accommodation capacity is relatively large, are provided.

(2) It is possible to facilitate an operation that injects ink into the liquid accommodation units 30 by displacing the injection openings 35 to positions at which it is easy to inject ink into the printer main body 12.

(3) Since it is possible for the operator to perceive amounts of ink that are accommodated in the liquid accommodation units 30 by eyesight, for example, it is possible to easily notice a timing for injecting ink into the liquid accommodation units 30 or the like, or a timing at which a state in which the liquid accommodation units 30 are filled with ink should be set. Therefore, it is possible to easily set a state in which the liquid accommodation units 30, which are provided in the printer main body 12, are filled with ink for printing (recording) while suppressing an increase in the installation area of the printer 11.

(4) Even if the supply cassette 40 is set to be a supply cassette in which the length in the perpendicular direction is large, and which is capable of supplying a relatively large number of sheets of paper P, the printer 11 can suppress a loss in pressure inside the liquid supply tubes 50 without a distance between the liquid accommodation units 30 and the liquid ejecting head 16 becoming long. In other words, it is possible for the printer 11 to be provided with a supply cassette 40 in which it is possible to arbitrarily change the number of sheets of paper P that can be accommodated without causing a change in the loss of pressure inside the liquid supply tubes 50.

(5) Since the discharge unit 20 is positioned on the discharge direction side of sheets of paper P in the printer main body 12, easy access to the liquid accommodation units 30 from the discharge side of sheets of paper P is made possible.

(6) Since it is possible for the operator to easily access the liquid accommodation units 30 from the discharge direction of sheets of paper P, it is possible to easily set a state in which the liquid accommodation units 30 are filled with ink.

(7) Since it is possible to move the liquid accommodation units 30 inside the printer main body 12 to a position at which it is possible for an operator to access the liquid accommodation units 30 by the sliding mechanism that is provided in the storage unit 32, it is possible to easily set a state in which the liquid accommodation units 30 are filled with ink.

(8) By storing the liquid accommodation units 30 in the freely moveable storage unit 32, it is possible to make movement of the liquid accommodation units 30 in the printer main body 12 possible with a simple configuration.

(9) It is possible to supply ink from the liquid accommodation units 30 to the liquid ejecting head 16 without obstructing the discharge of sheets of paper P to the discharge unit 20. In addition, since, normally, in sheets of paper P, the length in the discharge direction is longer than the length in a direction that intersects the discharge direction, it is possible to suppress the lengths of the liquid supply tubes 50 by setting arrangement positions of the liquid supply tubes 50 to the direction that intersects the discharge direction of sheets of paper P.

(10) Since it is possible for the operator to access the liquid accommodation units 30 from the discharge direction of sheets of paper P without the liquid supply tubes 50 becoming an obstruction, it is possible to easily set a state in which the liquid accommodation units 30 are filled with ink.

(11) The liquid recovery unit 60 is provided in a position that is in a lower section of the discharge unit 20 of sheets of paper P, and overlaps with the discharge unit 20. Therefore, in the printer 11, it is possible to easily perform an operation that exchanges the liquid recovery unit 60 by accessing the liquid recovery unit 60 from an occupied region of the discharge unit 20 that is provided on a discharge side of sheets of paper P without obstructing the discharge of sheets of paper P, and without the operator moving the printer 11. In addition, since the liquid recovery unit 60 is provided inside the printer main body 12 of the printer 11, it is possible to suppress an increase in the installation area of the printer 11.

(12) In the printer 11 that is provided with the supply cassette 40, the liquid recovery unit 60 suppresses an increase in the installation area of the printer 11 by overlapping with the discharge unit 20 in a lower section of the discharge unit 20. In addition, since the liquid recovery unit 60 is not separated from the liquid ejecting head 16 as a result of being positioned in an upper section of the supply cassette 40, it is possible to easily recover ink that is discharged from the liquid ejecting head 16.

(13) Since it is possible to move the liquid recovery unit 60 from the printer main body 12 to a position at which exchange of the ink absorbing material 62 is possible by pulling the liquid recovery unit 60 out, it is possible for the operator to easily perform an exchange operation of the liquid recovery unit 60 (the ink absorbing material 62).

(14) Since the discharge unit 20 is positioned on the discharge direction side of sheets of paper P in the printer main body 12, easy access to the liquid recovery unit 60 from the discharge side of sheets of paper P is made possible.

(15) Even if a liquid recovery unit 60 that is not provided with a movement mechanism is provided, it is possible to move the liquid recovery unit 60 to a position in the printer main body 12 at which exchange is easy by storing the liquid recovery unit 60 in the storage unit 32 that is freely moveable.

Second Embodiment

The printer 11 of the second embodiment has a configuration in which the liquid recovery unit 60 (the liquid accommodation units 30) in the abovementioned first embodiment is provided in a lower section of the supply cassette 40 instead of between the discharge unit 20 and the supply cassette 40. The printer 11 of the second embodiment will be described with reference to the drawings. Additionally, in the drawings that are referred to in this instance, like symbols are given to constituent members that are the same as those of the abovementioned first embodiment, and the description thereof has been omitted.

As shown in FIG. 10, in the printer 11 of the second embodiment, the supply cassette 40 is positioned in an upper section of the lower unit side housing 12B of the printer main body 12, and the liquid accommodation units 30 and the liquid recovery unit 60 are positioned in a lower section (the −Z direction) of the supply cassette 40 in a manner that overlaps with the supply cassette 40. Therefore, the storage unit 32 that stores the liquid recovery unit 60 is also positioned in the lower section of the supply cassette 40. As a result of this, the supply pathway KK of sheets of paper P that are supplied from the supply cassette 40 toward the liquid ejecting head 16, is formed above (the +Z direction) the liquid recovery unit 60, which is stored in a rear section of the liquid accommodation units 30.

Therefore, although illustration has been omitted in this instance, it is not necessary to provide the supply pathway KK of sheets of paper P in a rear section of the liquid recovery unit 60, and the supply pathway KK of sheets of paper P does not change depending on the shape of the liquid recovery unit 60. In addition, since it is not necessary to provide the supply pathway KK of sheets of paper P in a rear section of the liquid recovery unit 60, it is possible to increase the occupied region of the liquid recovery unit 60, which is permitted in the lower unit side housing 12B of the printer main body 12, to be larger than that of the abovementioned first embodiment in the front-rear direction (the ±Y direction), which is the discharge direction of sheets of paper P.

Figure 11:
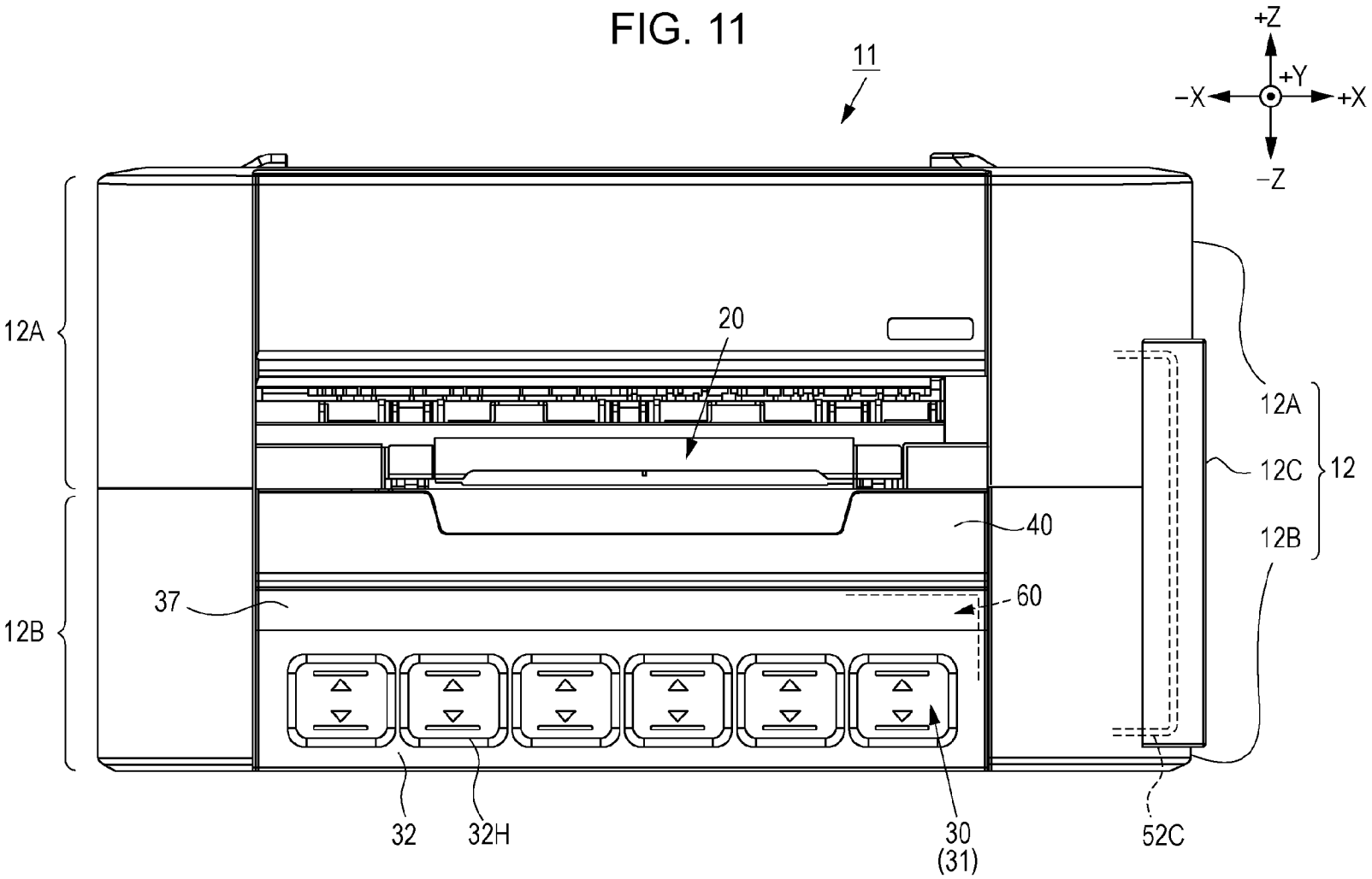
FIG. 11 is a front view that shows a printer with a configuration in which the liquid recovery unit is positioned below the supply cassette.

Additionally, since the liquid recovery unit 60 (the liquid accommodation units 30) are positioned on the lower section of the supply cassette 40, the length of the bent flow channel unit 52C in a vertical direction is increased in comparison with the case of the abovementioned embodiment in the manner that is shown by the broken line in FIG. 11. In addition, the lid housing 12C that covers the elongated bent flow channel unit 52C also takes on a vertically elongated shape.

According to the second embodiment, the following effect is exhibited in place of effect (12) in the abovementioned first embodiment.

(16) By changing the size (the thickness) of the liquid recovery unit 60 while suppressing an increase in the installation area as a result of the liquid recovery unit 60 overlapping with the discharge unit 20, it is possible to easily set an amount of ink that can be recovered in the liquid recovery unit 60 to be larger without changing the supply pathway KK of sheets of paper P from the supply cassette 40.

Third Embodiment

The printer 11 of the third embodiment has a configuration in which the liquid recovery unit 60 in the abovementioned first embodiment is provided inside the supply cassette 40. An example of the third embodiment will be described with reference to the drawings. Additionally, in the drawings that are referred to in this instance, like symbols are given to constituent members that are the same as those of the abovementioned first embodiment, and the description thereof has been omitted.

Figure 12:
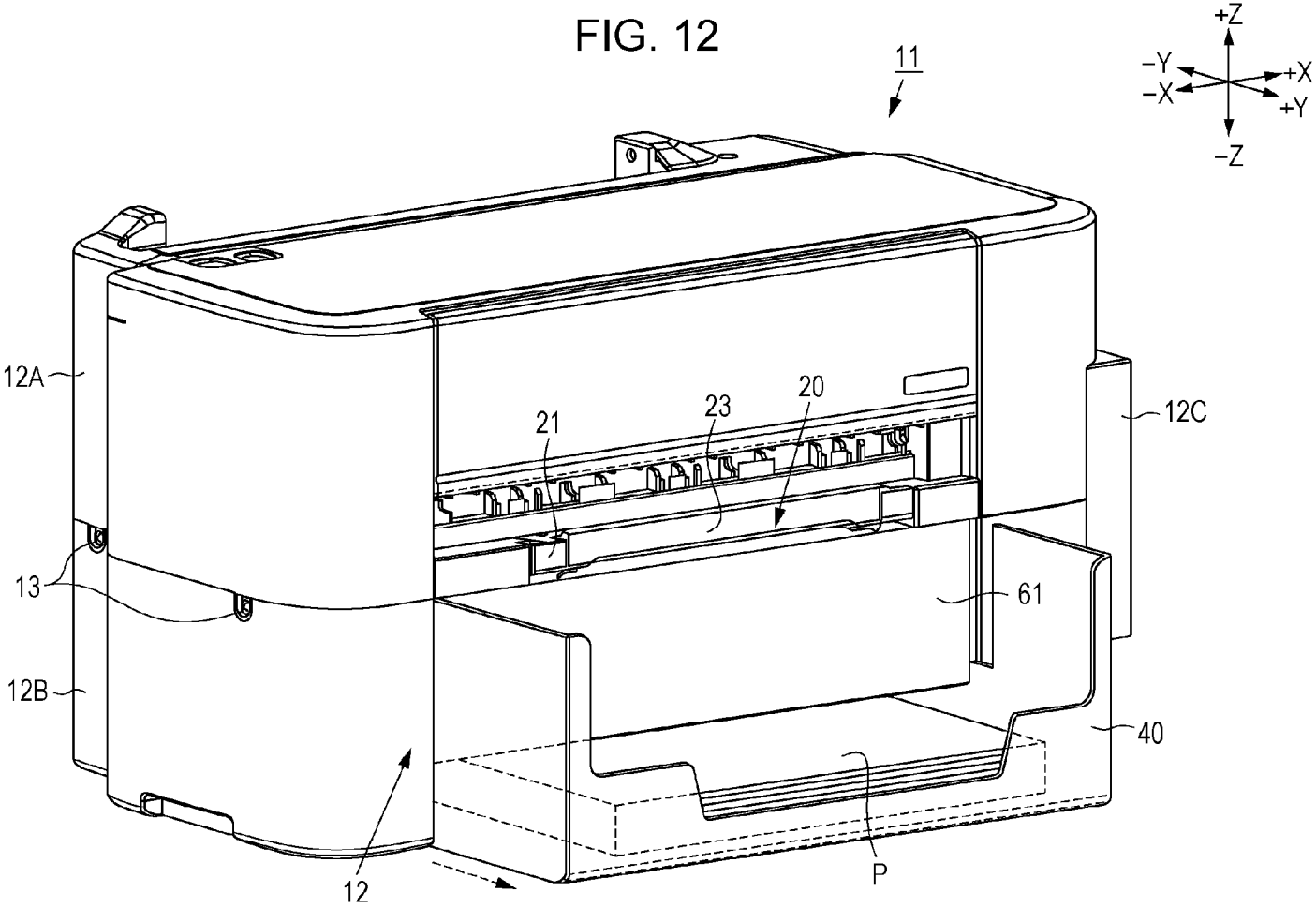
FIG. 12 is a perspective view that shows a printer in which the liquid recovery unit is provided inside the supply cassette.

As shown in FIG. 12, in the printer 11 of the third embodiment, the supply cassette 40 is provided so as to be detachable with respect to the lower unit side housing 12B, which is positioned on the gravitational (the −Z direction) side in the perpendicular direction, and the liquid recovery unit 60 (the case body 61) that recovers ink that is discharged from the liquid ejecting head 16, is provided inside the supply cassette 40.

In the present embodiment, the liquid recovery unit 60 is provided inside the supply cassette 40 on a side of a pull-out direction from the printer main body 12, and is provided so as to capable of sliding inside the supply cassette 40 in the front-rear direction (the ±Y direction) as a result of a sliding structure, which is not shown in the drawing, and which is provided in the case body 61. Additionally, in the liquid recovery unit 60, a sliding mechanism is directly provided in the case body 61 without providing the storage unit 32 of the abovementioned first embodiment. Naturally, a configuration in which the case body 61 is stored in the storage unit 32 that is capable of sliding, may also be used in the present embodiment.

Further, in a case in which sheets of paper P are accommodated inside the supply cassette 40, a portion of the supply cassette 40 is pulled out from the printer main body 12 (the lower unit side housing 12B) in the manner that is shown by the broken line arrow in FIG. 12. At this time, the case body 61 of the liquid recovery unit 60 remains inside the printer main body 12. As a result of this, it is possible to accommodate sheets of paper P on an inner bottom surface of the supply cassette 40 in a laminated state from the near side of the liquid recovery unit 60. Additionally, a state in which it is possible to supply sheets of paper P to the liquid ejecting head 16 is set by inserting the supply cassette 40 inside the printer main body 12 after accommodation of sheets of paper P.

Figure 13:
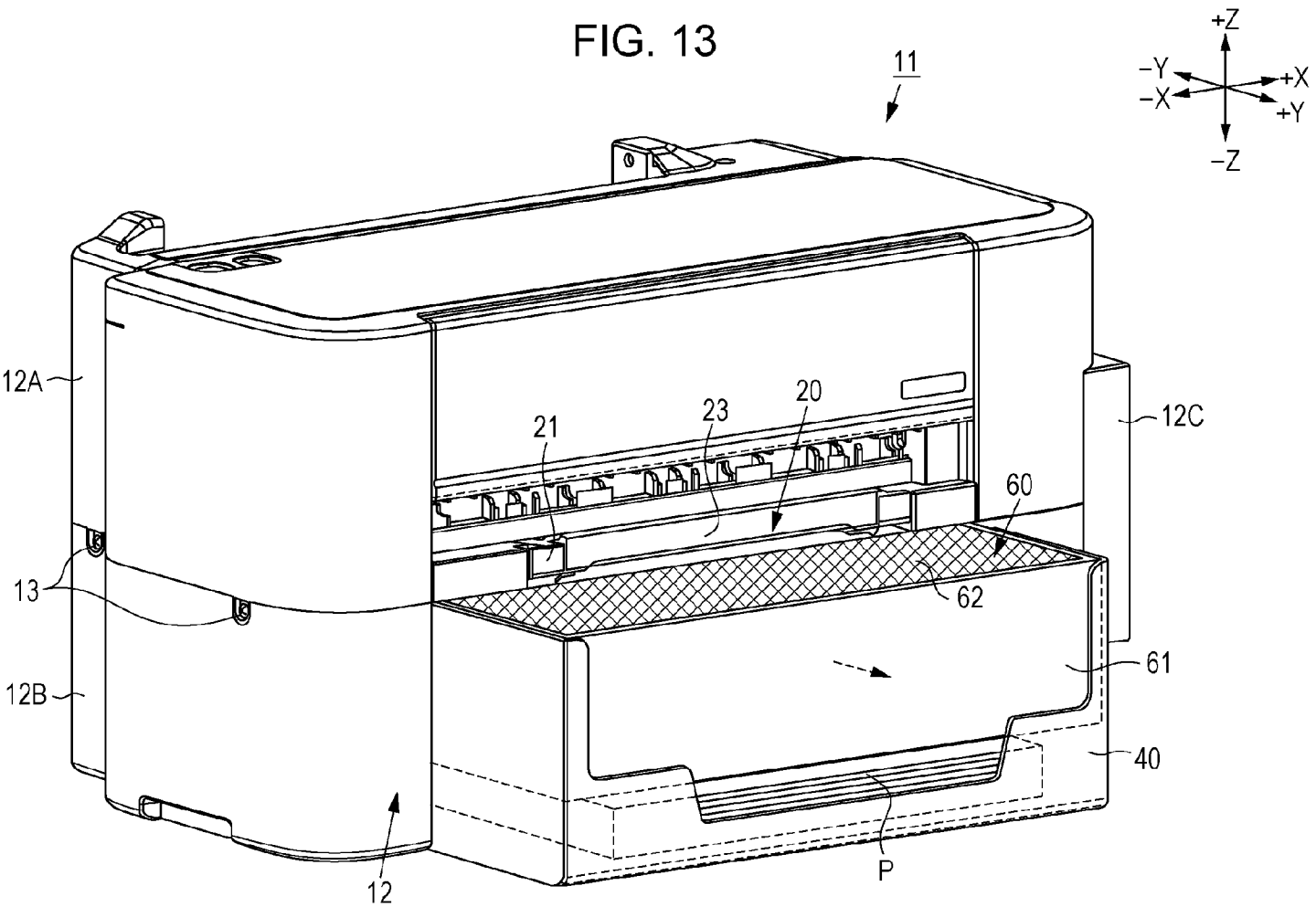
FIG. 13 is a perspective view that shows a printer in a state in which the liquid recovery unit, which is provided inside the supply cassette, has been drawn out from a printer main body.

Subsequently, as shown in FIG. 13, in the state in which a portion of the supply cassette 40 is pulled out from the printer main body 12, the case body 61 of the liquid recovery unit 60 can slide in the front-rear direction (the ±Y direction). In the present embodiment, in the liquid recovery unit 60, the ink absorbing material 62 inside the case body 61 is drawn out to the outside of the printer main body 12 as a result of the movement of the case body 61.

Therefore, by sliding the liquid recovery unit 60 to a front section following the supply cassette 40 in the manner that is shown by the broken line arrow in FIG. 13, it is possible for an operator to exchange the ink absorbing material 62 by drawing the ink absorbing material 62 out to the front section (the +Y direction) side of the printer main body 12. In other words, the ink absorbing material 62 is configured so that at least a portion thereof is drawn out to the to the outside of the of the printer main body 12 as a result of the sliding of the case body 61 by the operator.

Furthermore, in the printer 11 of the third embodiment, in addition to the liquid recovery unit 60, the liquid accommodation units 30 that are capable of accommodating ink that is supplied to the liquid ejecting head 16, may also be provided inside the supply cassette 40. For example, although illustration has been omitted in this instance, as shown in FIG. 6 in the first embodiment, a configuration in which the storage unit 32 in which the liquid accommodation units 30 and the liquid recovery unit 60 are stored, is provided inside the supply cassette 40 in a sliding manner, may be used. Additionally, in this configuration, as a result of storing the liquid recovery unit 60 in the storage unit 32 so the liquid recovery unit 60 is positioned further on the front section side than the liquid accommodation unit 30, it is possible to move the liquid recovery unit 60 to a position at which exchange of the ink absorbing material 62 is possible by drawing a portion of the supply cassette 40 out from the printer main body 12.

According to the third embodiment, the following effects are exhibited in addition to effects (1) to (15) of the abovementioned first embodiment.

(17) Since the liquid recovery unit 60 is provided inside the supply cassette 40 in a lower section of the discharge unit 20, in addition to suppressing an increase in the installation area of the printer 11, it is possible to move the liquid recovery unit 60 to the outside of the printer main body 12 by pulling out the supply cassette 40 from the printer main body 12.

(18) Since it is possible for the operator to easily move the liquid recovery unit 60, which is positioned on the front section side of the printer main body 12 to the outside of the printer main body 12 by pulling a portion of the supply cassette 40 out from the printer main body 12, it is possible to easily exchange the liquid recovery unit 60.

(19) In addition to supplying ink from the supply cassette 40 to the liquid ejecting head 16, the printer 11 can recover ink that has been discharged from the liquid ejecting head 16 to the supply cassette 40 using the liquid recovery unit 60 that is provided inside the supply cassette 40.

Modification Examples

Additionally, the abovementioned embodiments may be changed to other embodiments such as those below.

- In the abovementioned first embodiment and second embodiment, the liquid accommodation units 30, which are capable of accommodating ink that is supplied to the liquid ejecting head 16 via the liquid supply tubes 50, need not be provided in the printer main body 12. For example, in a case of a configuration in which it is possible to supply ink to the liquid ejecting head 16 from ink cartridges that are provided in the carriage 15, the liquid accommodation units 30 are not required. In this configuration, it is possible to increase size of the liquid recovery unit 60 inside the printer main body 12 up to the occupied region of the liquid accommodation units 30.
- In the abovementioned third embodiment, the liquid accommodation units 30, which are capable of accommodating ink that is supplied to the liquid ejecting head 16, need not be provided in the supply cassette 40. For example, in a case of a configuration in which it is possible to supply ink to the liquid ejecting head 16 from ink cartridges that are provided in the carriage 15, the liquid accommodation units 30 are not required. In this configuration, it is possible to increase size of the liquid recovery unit 60 inside the supply cassette 40 up to the occupied region of the liquid accommodation units 30.
- In the abovementioned first embodiment and second embodiment, the movement mechanism, which is capable of moving the liquid recovery unit 60 need not necessarily be provided in the printer main body 12. For example, if a portion of the case body 61 is configured to be removable, and it is possible to exchange the ink absorbing material 62 via an aperture that is provided through removal of the portion, it is not necessary to move the liquid recovery unit 60.
- In the abovementioned third embodiment, the liquid recovery unit 60 may be provided inside the supply cassette 40 in a state in which the liquid recovery unit 60 cannot slide inside the supply cassette 40 in the front-rear direction (the ±Y direction). Even if such as configuration is used, for example, it is possible to pull the liquid recovery unit 60 out to the outside of the printer main body 12 by pulling the supply cassette 40 out from the printer main body 12.
- In the abovementioned first embodiment and second embodiment, a configuration in which the liquid recovery unit 60 is provided further on the front section side of the printer main body 12 than the liquid accommodation units 30, may be used. In a case in which the frequency of the injection of ink into the liquid accommodation units 30 is low, or in a case of a configuration in which ink is not injected into the liquid accommodation units 30 from the injection openings 35, the liquid accommodation units 30 are provided on the rear section side that is opposite to the side of a pull-out direction (the front section side) of the printer main body 12, and the liquid recovery unit 60 is provided on the side of a pull-out direction of the printer main body 12. If such as configuration is used, it is possible to pull the liquid recovery unit 60 out to the outside of the printer main body 12 with a less movement.
- In the abovementioned third embodiment, the liquid recovery unit 60 need not necessarily be provided inside the supply cassette 40 on the side of a pull-out direction from the printer main body 12. In a case in which the frequency of the exchange of the ink absorbing material 62 in the liquid recovery unit 60 is low, or in a case of being separated from the liquid ejecting head 16 when positioned on the side of the pull-out direction, a configuration in which the liquid recovery unit 60 is provided inside the supply cassette 40 on the rear section side that is opposite to the side of a pull-out direction (the front section side) from the printer main body 12, may be set.
- In the abovementioned embodiments, a configuration in which the liquid accommodation units 30 are provided with liquid accommodation bodies 31 that have structures other than an ink tank, which are formed by a rigid material, may be set. For example, an ink pouch that is capable of accommodating ink inside a pouch unit (a bag) that is formed by a sheet member with low rigidity and excellent flexibility, may be set as the liquid accommodation body 31.
- In the abovementioned embodiments, the liquid supply tubes 50 need not necessarily be connected to the liquid accommodation units 30 at an end unit of a side that in the opposite direction to the discharge direction (the +Y direction) of sheets of paper P. For example, in the liquid supply tubes 50, the end 51*a* may be connected to the liquid accommodation units 30 on the gravitational direction (the −Z direction) side. Alternatively, for example, in a case in which the liquid accommodation units 30 are formed by a single liquid accommodation body 31, in the liquid supply tubes 50, the end 51*a* may be connected to the liquid accommodation units 30 on the left direction (the +X direction) side.

In the abovementioned embodiments, the liquid supply tubes 50 need not necessarily be arranged on an outer side of the discharge unit 20 in a direction (the ±X direction) that intersects the discharge direction (the +Y direction) of sheets of paper P. For example, the liquid supply tubes 50 may be arranged in the opposite direction (the −Y direction) to the discharge direction (the +Y direction) of sheets of paper P in positions that that do not obstruct the feeding of sheets of paper P that are supplied from the supply cassette 40 to the liquid ejecting head 16 side. Naturally, in this case, although detailed description has been omitted, the arrangement positions of the liquid supply tubes 50 inside the printer main body 12 from the liquid accommodation units 30 to the carriage 15 differ from the abovementioned embodiments.

In the abovementioned embodiments, in the liquid accommodation units 30, the liquid amount visual recognition sections 33 through which it is possible to visually recognize amounts of ink that are accommodated in the liquid accommodation units 30 need not necessarily be provided. For example, the liquid amount visual recognition sections 33 are not required in a case of a configuration in which it is possible to calculate an ink consumption amount that is ejected from the liquid ejecting head 16 in the printer 11, and it is possible to notify a user of a remaining amount of ink inside the liquid accommodation units 30 using the calculated ink consumption amount.

In the abovementioned embodiments, the liquid accommodation units 30 may be provided on a lower side of the supply cassette 40 instead of between the discharge unit 20 and the supply cassette 40. This modification example will be described with reference to the drawings.

Figure 8:
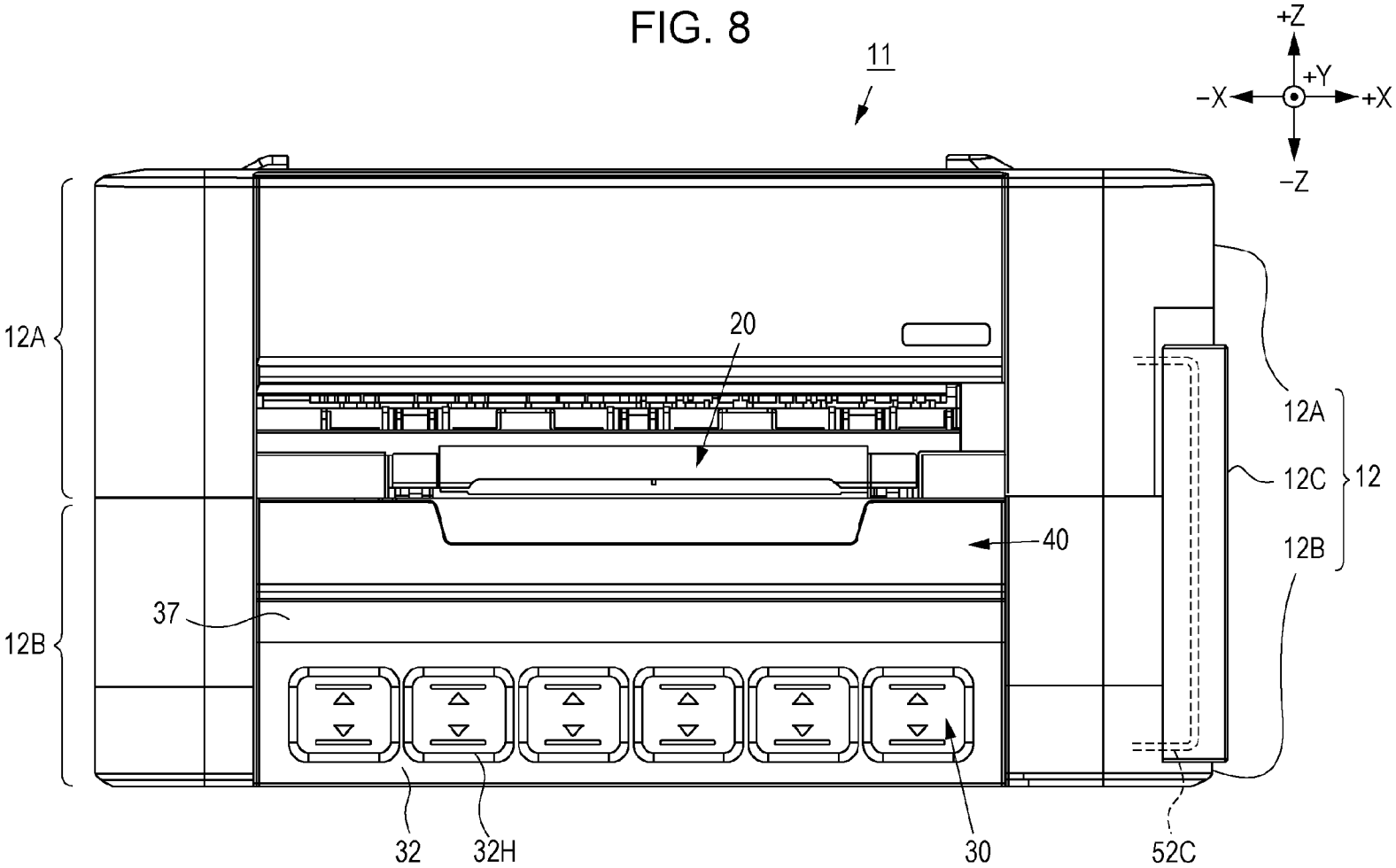
FIG. 8 is a front view that shows a printer with a configuration in which the liquid accommodation units are positioned below the supply cassette.

As shown in FIG. 8, the supply cassette 40 is positioned in an upper section of the lower unit side housing 12B of the printer main body 12, and the liquid accommodation units 30 are positioned in a lower section (the −Z direction) thereof in a manner that overlaps with the supply cassette 40 in the perpendicular direction. Therefore, the storage unit 32 that stores the liquid accommodation units 30 is also positioned in a lower section of the supply cassette 40. As a result of this, the supply pathway KK of sheets of paper P which are supplied from the supply cassette 40 toward the liquid ejecting head 16, is formed above (the +Z direction) the liquid accommodation units 30. Therefore, although illustration has been omitted in this instance, since it is not necessary to provide the supply pathway KK of sheets of paper P, it is possible to increase the occupied region of the liquid accommodation units 30, which is permitted in the lower unit side housing 12B of the printer main body 12, to be larger than that of the abovementioned embodiments in the front-rear direction (the ±Y direction), which is the discharge direction of sheets of paper P.

Additionally, since the liquid accommodation units 30 are disposed in the lower section of the supply cassette 40, in comparison with the cases of the abovementioned embodiments, the length in the vertical direction of the bent flow channel unit 52C is elongated in the manner that is shown by the broken line in FIG. 8. In addition, the lid housing 12C that covers the elongated bent flow channel unit 52C also takes on a vertically elongated shape.

According to the present modification example, the following effect is exhibited in place of effect (4) in embodiment 1.

(20) Although flow loss is increased by the liquid supply tubes 50 being elongated, by changing the size of the liquid accommodation units 30, it is possible to easily change amounts of ink that are accommodated in the liquid accommodation units 30 without changing the supply pathway KK of sheets of paper P.

In the abovementioned embodiments, a configuration in which the liquid accommodation units 30 are provided with liquid accommodation bodies 31 that have structures other than an ink tank, which are formed by a rigid material, may be set. For example, an ink pouch 39 that is capable of accommodating ink inside a pouch unit (a bag) that is formed by a sheet member with low rigidity and excellent flexibility, may be set as the liquid accommodation body 31. This modification example will be described with reference to the drawings.

Figure 9:
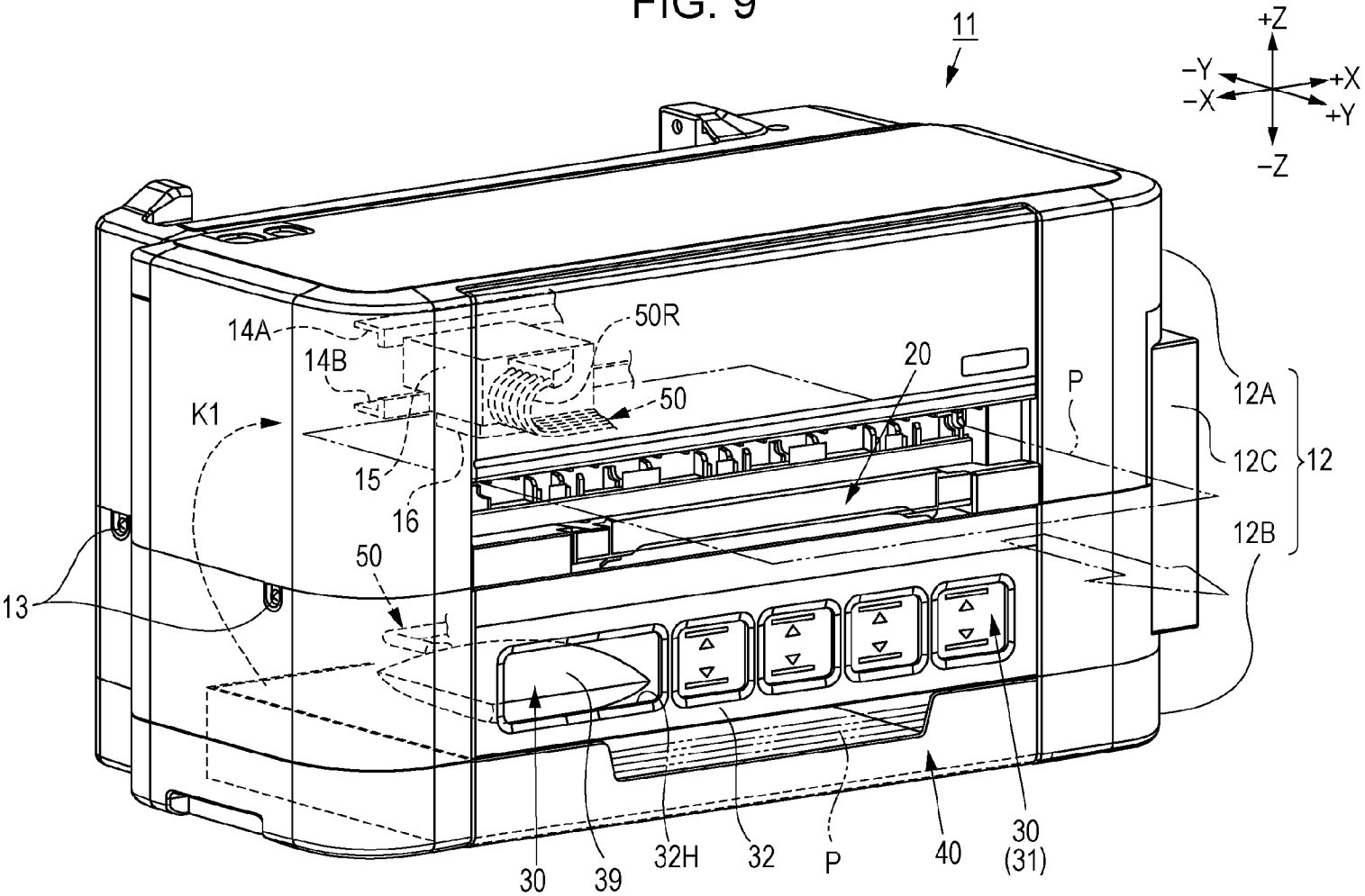
FIG. 9 is a perspective view that shows a printer in which an ink pouch is provided in the liquid accommodation units.

As shown in FIG. 9, in the present modification example, a configuration in which a single ink pouch 39 is set in place stead of the two liquid accommodation bodies 31 that are positioned in the left direction (the −X direction) when viewed from the front surface side in the above-described embodiments. That is, in the modification example, the liquid accommodation units 30 supply ink to the liquid ejecting head 16 from a single ink pouch 39 and four liquid accommodation bodies 31. Naturally, a configuration in which all six of the liquid accommodation bodies 31 are substituted with ink pouches 39, may also be used.

In a case in which the liquid accommodation bodies 31 are configured by ink pouches 39 in the liquid accommodation units 30 in the manner of the present modification example, it is possible to visually recognize the shape of the pouch unit of the ink pouch 39 via the substantially square shaped through hole 32H that is provided on the front side surface of the storage unit 32. That is, by visually recognizing a changed shape of a pouch unit that has changed to a manner that is crushed, it is possible to recognize a decreased condition of ink that is accommodated in the ink pouch 39. Therefore, in the present modification example, the through hole 32H functions as the liquid amount visual recognition section 33.

Additionally, in the present modification example, an operation that sets a state of being filled with ink is performed on an ink pouch 39 that has been visually recognized as an ink pouch 39 in which there is no ink. With respect to this operation, in a case in which an injection opening through which it is possible to inject ink into the ink pouch 39, is provided, ink is injected inside the pouch unit from the injection opening in the same manner as the abovementioned embodiments. Alternatively, in a case in which an injection opening through which it is possible to inject ink into the ink pouch 39, is not provided, the connection of the liquid supply tubes 50 is unfastened, and the liquid supply tubes 50 are connected again after replacing the ink pouch 39 with a separate ink pouch 39 which is in a state of being filled with ink. Naturally, during these operations, it is preferable that the operator perform drawing-out of the liquid accommodation units 30 (the ink pouch 39) from the printer main body 12.

In the abovementioned embodiments, the liquid supply tubes 50 need not necessarily be connected to the liquid accommodation units 30 at the end unit of a side that is in the opposite direction to the discharge direction (the +Y direction) of sheets of paper P. For example, in the liquid supply tubes 50, the end 51*a* may be connected to the liquid accommodation units 30 on the gravitational direction (the −Z direction) side. Alternatively, for example, in a case in which the liquid accommodation units 30 are formed by a single liquid accommodation body 31, in the liquid supply tubes 50, the end 51*a* may be connected to the liquid accommodation units 30 on the left direction (the −X direction) side.

In the abovementioned embodiments, the liquid supply tubes 50 need not necessarily be arranged on an outer side of the discharge unit 20 in a direction (the ±X direction) that intersects the discharge direction (the +Y direction) of sheets of paper P. For example, the liquid supply tubes 50 may be arranged in the opposite direction (the −Y direction) to the discharge direction (the +Y direction) of sheets of paper P in positions that that do not obstruct the feeding of sheets of paper P that are supplied from the supply cassette 40 to the liquid ejecting head 16 side. Naturally, in this case, although detailed description has been omitted, the arrangement positions of the liquid supply tubes 50 inside the printer main body 12 from the liquid accommodation units 30 to the carriage 15 differ from the abovementioned embodiments.

In the abovementioned embodiments, in the liquid accommodation units 30, the liquid accommodation units 30 need not necessarily have a configuration of moving as a result of the storage unit 32 that moves by sliding. For example, a configuration in which a movement mechanism is provided in the liquid accommodation units 30, and the liquid accommodation units 30 move directly without moving via the marks 32, may also be used. In this case, the storage unit 32 of the liquid accommodation units 30 need not necessarily be provided in the printer main body 12.

In the abovementioned embodiments, the movement mechanism, which is capable of moving the liquid accommodation units 30 need not necessarily be provided in the printer main body 12. For example, although illustration has been omitted, in a case in which the ink injection openings 35 are positioned to be exposed to the front surface side (the +Y direction side) of the liquid accommodation units 30 (the storage unit 32), it is not necessary to draw the liquid accommodation units 30 out to the outside of the printer main body 12 through movement thereof.

In the abovementioned embodiments, the liquid accommodation units 30 need not necessarily be provided inside the printer main body 12 at the end unit side in the discharge direction (the +Y direction) of sheets of paper P. For example, the liquid accommodation units 30 may be provided inside the printer main body 12 at the end unit side in the direction (the −Y direction) that is opposite to the discharge direction (the +Y direction) of sheets of paper P. In short, as long as the liquid accommodation units 30 are provided in a position that is below the discharge unit 20 in the perpendicular direction and overlaps with the discharge unit 20 in the perpendicular direction, the printer 11 suppresses an increase in the installation area thereof. Naturally, in this case, it is preferable that the liquid accommodation units 30 be provided in position in which movement to the outside of the printer main body 12 is possible by sliding.

In the abovementioned embodiments, the liquid accommodation units 30 need not necessarily be provided between the discharge unit 20 and the supply cassette 40. For example, in a case in which a supply unit of sheets of paper P is provided in a rear section of the printer main body 12, or the like, the liquid accommodation units 30 may be provided in positions that overlap with the discharge unit 20 in the printer 11 with a configuration in which the supply cassette 40, which is capable of accommodating sheets of paper P, is not provided below the discharge unit 20 in the perpendicular direction.

In the abovementioned embodiments, the liquid accommodation units 30 may not provide with the liquid amount visual recognition sections 33 through which it is possible to visually recognize amounts of ink that are accommodated in the liquid accommodation units 30. For example, the liquid amount visual recognition sections 33 are not required in a case of a configuration in which it is possible to calculate an ink consumption amount that is ejected from the liquid ejecting head 16 in the printer 11, and it is possible to notify a user of a remaining amount of ink inside the liquid accommodation units 30 using the calculated ink consumption amount.

In the abovementioned embodiments, the injection openings 35 need not necessarily be provided so as to be capable of being displaced with respect to the printer main body 12. For example, it is not necessary to displace the injection openings 35 if it is possible to inject ink from the injection openings 35 without displacing the injection opening 35.

In the abovementioned embodiments, the liquid accommodation units 30 need not necessarily be provided with the injection openings 35 through which it is possible to inject ink. For example, in a case in which the liquid accommodation units 30 are configured by the ink pouch 39 in the manner of the abovementioned modification example, an ink pouch 39 in which there is no ink is substituted with a new ink pouch 39 which is in a state of being filled with ink without injecting ink inside the bag. Therefore, in such a case, it is not necessary to provide the liquid accommodation units 30 with ink injection openings 35.

The liquid ejecting head 16 is not limited to a so-called serial belt type that ejects ink by reciprocating with the carriage 15 in a direction that intersects the transport direction of sheets of paper P. That is, the liquid ejecting head 16 may also be a so-called line head type in which a length size is an entire shape that corresponds to the width size of sheets of paper P, and which ejects a liquid toward a medium from a plurality of nozzles that are provided so as to substantially span an entire longitudinal direction of sheets of paper P in a state in which the longitudinal direction is fixed and arranged so as to run along a width direction that intersects the discharge direction of sheets of paper P.

In the abovementioned embodiments, the printer 11 may be a recording apparatus that ejects of spouts a liquid other than ink. Additionally, as a state of the liquid that is spouted as minute liquid droplets from the recording apparatus, it is possible to include granules, tears, and filaments that leave a trail. In addition, the liquid that is referred to in this instance may be any material that is capable of being ejected from a recording apparatus. For example, the liquid may be set to include any substance that is in a state in which the physical property is a liquid phase, liquids with high or low viscosities, or fluids such as sols, gel waters, other inorganic solvents, organic solvents, solutions, liquid resins and liquid metals (metallic melts). Further, in addition to liquids for which the physical property is a single state, the liquid may be set to include liquids in which particles of a functional material that are made from solid objects such as pigments or metal particles are dissolved, dispersed or mixed in solvents. It is possible to include an ink such as that described in the abovementioned embodiments or liquid crystal as representative examples of a liquid. In this instance, the ink may be set to contain general aqueous ink and oil-based ink, and various liquid compositions such as gel ink, hot melt ink and the like. For example, as a concrete example of a recording apparatus, there are recording apparatuses that eject liquids that include materials such as electrode materials and color materials, which are used in the manufacturing of liquid crystal displays, electroluminescence (EL) displays, surface-emitting displays, color filters and the like in a dispersed or dissolved form. In addition, recording apparatuses that eject living organic material that is used in the manufacture of biochips, recording apparatuses that eject liquids that form specimens that are used as precision pipettes, printing equipment, microdispensers and the like may also be used. Furthermore, recording apparatuses that eject a lubricating oil with pinpoint precision in a precision instrument such as a watch or a camera, recording apparatuses that eject a transparent resin liquid such as an ultraviolet curable resin for forming a microhemispherical lens (an optical lens) or the like that is used in optical communication elements or the like onto a substrate may also be used. In addition, recording apparatuses that eject an etching liquid such as an acid or an alkali for etching a substrate or the like may also be used.

REFERENCE SIGNS LIST

11 PRINTER (AN EXAMPLE OF RECORDING APPARATUS)
12 PRINTER MAIN BODY (AN EXAMPLE OF APPARATUS MAIN BODY)
16 LIQUID EJECTING HEAD
20 DISCHARGE UNIT
25 DISCHARGE OPENING
27 DISCHARGE ROLLER
28 DRIVEN ROLLER
30 LIQUID ACCOMMODATION UNIT
32 STORAGE UNIT
33 LIQUID AMOUNT VISUAL RECOGNITION SECTION
35 INJECTION OPENING
40 SUPPLY CASSETTE
50 LIQUID SUPPLY TUBE
60 LIQUID RECOVERY UNIT
P PAPER (AN EXAMPLE OF TARGET)

The invention claimed is:

1. A recording apparatus comprising:
a liquid ejecting head that performs recording by ejecting a liquid onto a target;
a discharge unit in which a discharge opening that includes a discharge region at which the target, on which recording was performed by the liquid ejecting head, is discharged, is formed;
liquid accommodation units that accommodate liquid accommodation bodies that are capable of accommodating the liquid that is supplied to the liquid ejecting head;
a storage unit that stores the liquid accommodation units, in an apparatus main body; and
a movement mechanism that moves the storage unit,
wherein the discharge unit is formed on a discharge direction side of the target from discharge means that include a discharge roller that discharges the target, and
wherein the storage unit is provided below the discharge unit.

2. The recording apparatus according to claim 1, further comprising:
a liquid recovery unit that is capable of recovering the liquid that is discharged from the liquid ejecting head during maintenance of the liquid ejecting head,
wherein the liquid recovery unit is provided below the discharge unit in the perpendicular direction.

3. The recording apparatus according to claim 1,
wherein a supply cassette that is capable of accommodating the target that is supplied to the liquid ejecting head is provided in the apparatus main body in a position that is below the discharge unit in a perpendicular direction,
wherein the storage unit provided below the supply cassette.

4. The recording apparatus according to claim 1, further comprising liquid supply tubes that are connected to the liquid accommodation units, and are capable of supplying the liquid to the liquid ejecting head,
wherein the liquid supply tubes are arranged on an outer side of the discharge unit in a direction that intersects the discharge direction of the target, and supplies the liquid from a lower side of the discharge unit to an upper side thereof.

5. The recording apparatus according to claim 1, further comprising liquid supply tubes that are connected to the liquid accommodation units, and are capable of supplying the liquid to the liquid ejecting head,
wherein the liquid supply tubes are connected to the liquid accommodation units at an end unit of a side that in the opposite direction to the discharge direction of the target.

6. A recording apparatus comprising:
a liquid ejecting head that performs recording by ejecting a liquid onto a target;
a discharge unit in which a discharge opening that includes a discharge region at which the target, on which recording was performed by the liquid ejecting head, is discharged, is formed;
liquid accommodation units that accommodate liquid accommodation bodies that are capable of accommodating the liquid that is supplied to the liquid ejecting head;
a storage unit that stores the liquid accommodation units, in an apparatus main body;
a cover that covers the storage unit; and
wherein the discharge unit is formed on a discharge direction side of the target from discharge means that include a discharge roller that discharges the target, and
wherein the storage unit provided below the discharge unit.

7. The recording apparatus according to claim 6, further comprising:

a liquid recovery unit that is capable of recovering the liquid that is discharged from the liquid ejecting head during maintenance of the liquid ejecting head, wherein the liquid recovery unit is provided below the discharge unit in the perpendicular direction.

8. The recording apparatus according to claim 6, wherein a supply cassette that is capable of accommodating the target that is supplied to the liquid ejecting head is provided in the apparatus main body in a position that is below the discharge unit in a perpendicular direction, wherein the storage unit provided below the supply cassette.

9. The recording apparatus according to claim 6, further comprising liquid supply tubes that are connected to the liquid accommodation units, and are capable of supplying the liquid to the liquid ejecting head, wherein the liquid supply tubes are arranged on an outer side of the discharge unit in a direction that intersects the discharge direction of the target, and supplies the liquid from a lower side of the discharge unit to an upper side thereof.

10. The recording apparatus according to claim 6, further comprising liquid supply tubes that are connected to the liquid accommodation units, and are capable of supplying the liquid to the liquid ejecting head, wherein the liquid supply tubes are connected to the liquid accommodation units at an end unit of a side that in the opposite direction to the discharge direction of the target.

* * * * *